US008846284B2

(12) United States Patent
Kinumatsu et al.

(10) Patent No.: US 8,846,284 B2
(45) Date of Patent: Sep. 30, 2014

(54) TONER

(71) Applicant: Canon Kabushiki Kaisha, Tokyo (JP)

(72) Inventors: Tetsuya Kinumatsu, Numazu (JP); Atsushi Tani, Suntou-gun (JP); Kenji Aoki, Mishima (JP); Shuntaro Watanabe, Hadano (JP); Takaaki Kaya, Suntou-gun (JP); Ayako Okamoto, Wako (JP); Yoshihiro Nakagawa, Numazu (JP); Toshifumi Mori, Suntou-gun (JP); Takashige Kasuya, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/741,369

(22) Filed: Jan. 14, 2013

(65) Prior Publication Data

US 2013/0130165 A1 May 23, 2013

Related U.S. Application Data

(63) Continuation of application No. PCT/JP2012/064332, filed on Jun. 1, 2012.

(30) Foreign Application Priority Data

Jun. 3, 2011 (JP) ..... 2011-125765

(51) Int. Cl.

| | |
|---|---|
| ***G03G 9/00*** | (2006.01) |
| ***G03G 9/093*** | (2006.01) |
| ***G03G 9/087*** | (2006.01) |
| ***G03G 9/08*** | (2006.01) |

(52) U.S. Cl.

CPC ..... *G03G 9/0825* (2013.01); *G03G 9/09307* (2013.01); *G03G 9/09392* (2013.01); *G03G 9/08795* (2013.01); *G03G 9/0935* (2013.01); *G03G 9/0802* (2013.01); *G03G 9/08797* (2013.01); *G03G 9/09364* (2013.01)

USPC ..... 430/109.1; 430/109.3; 430/109.4; 430/137.1

(58) Field of Classification Search

USPC ..... 430/109.1, 109.3, 109.4, 110.2, 137.1

See application file for complete search history.

(56) References Cited

U.S. PATENT DOCUMENTS

| | | | |
|---|---|---|---|
| 5,135,833 | A | 8/1992 | Matsunaga et al. |
| 5,298,354 | A | 3/1994 | Matsunaga et al. |

(Continued)

FOREIGN PATENT DOCUMENTS

| | | | |
|---|---|---|---|
| JP | 8-295724 | A | 11/1996 |
| JP | 2001-305795 | A | 11/2001 |

(Continued)

OTHER PUBLICATIONS

Jushukugo (Polycondensation), Kagaku Dojin, 1971.

(Continued)

*Primary Examiner* — Thorl Chea

(74) *Attorney, Agent, or Firm* — Fitzpatrick, Cella, Harper and Scinto

(57) ABSTRACT

Provided is a toner comprising toner particles, wherein each of the toner particles has a core-shell structure composed of a core and a shell phase formed on the core, the shell phase contains a resin (B), and the core contains a binder resin (A), a colorant and a wax, wherein the toner particles contain the resin (B) in a specific amount with respect to the core, and wherein the solubility parameter (SP value) of the binder resin (A) is denoted by SP(A), the SP value of the resin (B) is denoted by SP(B), the SP value of a repeating unit with the smallest SP value from among repeating units constituting the resin (B) is denoted by SP(C), and the SP value of the wax is denoted by SP(W), each of the SP(A), SP(B), SP(C) and SP(W) satisfy specific relationships.

8 Claims, 3 Drawing Sheets

(56) References Cited

U.S. PATENT DOCUMENTS

| | | | | |
|---|---|---|---|---|
| 5,300,386 | A | 4/1994 | Kanbayashi et al. | |
| 5,354,639 | A | 10/1994 | Kasuya et al. | |
| 5,354,640 | A | 10/1994 | Kanbayashi et al. | |
| 5,407,776 | A | 4/1995 | Kanbayashi et al. | |
| 5,478,686 | A | 12/1995 | Kawakami et al. | |
| 5,500,321 | A | 3/1996 | Kasuya et al. | |
| 5,529,873 | A * | 6/1996 | Chiba et al. | 430/109.3 |
| 5,558,967 | A | 9/1996 | Nagatsuka et al. | |
| 5,571,653 | A | 11/1996 | Kasuya et al. | |
| 5,578,407 | A | 11/1996 | Kasuya et al. | |
| 5,691,093 | A | 11/1997 | Kanbayashi et al. | |
| 5,700,616 | A | 12/1997 | Kasuya et al. | |
| 5,712,073 | A | 1/1998 | Katada et al. | |
| 5,736,288 | A | 4/1998 | Kasuya et al. | |
| 5,814,429 | A | 9/1998 | Kawakami et al. | |
| 5,840,457 | A | 11/1998 | Urawa et al. | |
| 5,972,553 | A | 10/1999 | Katada et al. | |
| 6,002,895 | A | 12/1999 | Kasuya et al. | |
| 6,200,719 | B1 * | 3/2001 | Kuroda | 430/137.1 |
| 6,214,509 | B1 | 4/2001 | Kasuya et al. | |
| 6,300,024 | B1 | 10/2001 | Yusa et al. | |
| 6,485,875 | B1 | 11/2002 | Karaki et al. | |
| 6,569,589 | B2 | 5/2003 | Inaba et al. | |
| 6,586,151 | B1 | 7/2003 | Naka et al. | |
| 6,664,016 | B2 | 12/2003 | Kanbayashi et al. | |
| 6,703,176 | B2 | 3/2004 | Naka et al. | |
| 6,751,424 | B2 | 6/2004 | Komatsu et al. | |
| 6,875,549 | B2 | 4/2005 | Yamazaki et al. | |
| 6,881,527 | B2 | 4/2005 | Moribe et al. | |
| 6,905,808 | B2 | 6/2005 | Itakura et al. | |
| 7,001,703 | B2 | 2/2006 | Moribe et al. | |
| 7,014,969 | B2 | 3/2006 | Yachi et al. | |
| 7,097,951 | B2 | 8/2006 | Moribe et al. | |
| 7,147,980 | B2 | 12/2006 | Itakura et al. | |
| 7,150,953 | B2 | 12/2006 | Yamazaki et al. | |
| 7,229,727 | B2 | 6/2007 | Itakura et al. | |
| 7,238,387 | B2 | 7/2007 | Ogawa et al. | |
| 7,244,539 | B2 | 7/2007 | Baba et al. | |
| 7,267,919 | B2 | 9/2007 | Moribe et al. | |
| 7,273,686 | B2 | 9/2007 | Onuma et al. | |
| 7,288,354 | B2 | 10/2007 | Moribe et al. | |
| 7,361,441 | B2 | 4/2008 | Itakura et al. | |
| 7,402,368 | B2 | 7/2008 | Ogawa et al. | |
| 7,422,832 | B2 | 9/2008 | Ogawa et al. | |
| 7,452,649 | B2 | 11/2008 | Magome et al. | |
| 7,537,877 | B2 | 5/2009 | Yoshiba et al. | |
| 7,582,401 | B2 | 9/2009 | Ogawa et al. | |
| 7,678,524 | B2 | 3/2010 | Hasegawa et al. | |
| 7,700,254 | B2 | 4/2010 | Moribe et al. | |
| 7,704,659 | B2 | 4/2010 | Ogawa et al. | |
| 7,776,501 | B2 | 8/2010 | Tamura et al. | |
| 7,794,908 | B2 | 9/2010 | Kaya et al. | |
| 7,794,909 | B2 | 9/2010 | Kaya et al. | |
| 7,811,734 | B2 | 10/2010 | Ogawa et al. | |
| 7,935,771 | B2 | 5/2011 | Fukui et al. | |
| 7,939,231 | B2 | 5/2011 | Ogawa et al. | |
| 7,943,281 | B2 | 5/2011 | Kaya et al. | |
| 8,084,174 | B2 | 12/2011 | Hasegawa et al. | |
| 8,093,342 | B2 | 1/2012 | Minami et al. | |
| 8,110,329 | B2 | 2/2012 | Tominaga et al. | |
| 8,178,275 | B2 | 5/2012 | Tani et al. | |
| 8,372,573 | B2 | 2/2013 | Ayaki et al. | |
| 8,383,312 | B2 | 2/2013 | Fujimoto et al. | |
| 2006/0275679 | A1 | 12/2006 | Ishiyama et al. | |
| 2008/0124635 | A1 * | 5/2008 | Nakamura et al. | 430/48 |
| 2008/0286675 | A1 | 11/2008 | Tani et al. | |
| 2009/0305159 | A1 | 12/2009 | Zhou et al. | |
| 2010/0055593 | A1 | 3/2010 | Zhou et al. | |
| 2010/0062355 | A1 | 3/2010 | Kaya et al. | |
| 2011/0039200 | A1 | 2/2011 | Kaya et al. | |
| 2011/0045398 | A1 | 2/2011 | Sekikawa et al. | |
| 2011/0136054 | A1 | 6/2011 | Watanabe et al. | |
| 2011/0244383 | A1 | 10/2011 | Yamamoto et al. | |
| 2011/0300478 | A1 | 12/2011 | Sekikawa et al. | |
| 2012/0045717 | A1 | 2/2012 | Hiroko et al. | |
| 2012/0171607 | A1 | 7/2012 | Ayaki et al. | |
| 2012/0231384 | A1 | 9/2012 | Aoki et al. | |

FOREIGN PATENT DOCUMENTS

| | | | |
|---|---|---|---|
| JP | 2006-91283 | A | 4/2006 |
| JP | 2006-337751 | A | 12/2006 |
| JP | 2007-277511 | A | 10/2007 |
| JP | 2008-287088 | A | 11/2008 |
| JP | 2009-163026 | A | 7/2009 |
| JP | 2009-294655 | A | 12/2009 |
| JP | 2010-55094 | A | 3/2010 |
| JP | 2010-168522 | A | 8/2010 |
| JP | 2010-175933 | A | 8/2010 |
| JP | 2011-232738 | A | 11/2011 |
| WO | 2011/152008 | A1 | 12/2011 |

OTHER PUBLICATIONS

Kobunshi Jikkengaku: Jushukugo to Jufuka (Experiments in Polymer Science: Polycondensation and Polyaddition) Kyoritsu Shuppan, 1958.

Polyester Jushi Handbook (Polyester Resin Handbook), Nikkan Kogyo Shimbun,1988.

English translation of International Preliminary Report on Patentability, International Application No. PCT/JP2012/064332, Mailing Date Dec. 19, 2013.

Kaya, et al., U.S. Appl. No. 13/741,356, filed Jan. 14, 2013.

Watanabe, et al., U.S. Appl. No. 13/741,359, filed Jan. 14, 2013.

Aoki, et al., U.S. Appl. No. 13/741,372, filed Jan. 14, 2013.

Span, et al., "A New Equation of State for Carbon Dioxide Covering the Fluid Region from the Triple-Point Temperature to 1100 K at Pressures up to 800 MPa", Journal of Physical and Chemical Reference Data, vol. 25, No. 6, 1996, pp. 1509-1596.

International Search Report dated Aug. 7, 2012 in International Application No. PCT/JP2012/064332.

* cited by examiner

TONER

This application is a continuation of International Application No. PCT/JP2012/064332, filed Jun. 1, 2012, the contents of which are incorporated by reference herein.

BACKGROUND OF THE INVENTION

1. Field of the Invention

The present invention relates to a toner for use in a recording method using an electrophotographic method, an electrostatic recording method and a toner jet recording method.

2. Description of the Related Art

Previously, a large number of electrophotographic methods are known. A copied article is typically obtained by using a photoconductive material, forming an electrical latent image on an image bearing member (photosensitive body) by a variety of means, then obtaining a visible image by developing the latent image with a toner, transferring the toner image on a transfer material such as paper, as necessary, and then fixing the toner image on the transfer material by heat or pressure.

In recent years, a demand for inexpensive and small-size copiers and printers has grown following the rising popularity of such devices using the electrophotographic method, including household use thereof. In particular, in terms of cost efficiency and environment, the attention has been focused on the development of energy-efficient devices.

From the standpoint of energy efficiency, electrophotographic toners used in copiers and printers are required to have a low fixation temperature which results in low power consumption. To meet such a requirement, attempts have been made to design a toner with the lowered glass transition temperatures (Tg) of the binder resin and wax used therein or with the lowered melting temperature of the wax. However, such designs resulted in degraded stability in storage of the toner. Furthermore, under a high-temperature environment, the low-molecular weight components contained in the binder resin or the wax easily seeps out to the toner surface, thereby easily causing the aggregation of toner particles or filming.

A toner with a core-shell structure in which the surface of a resin serving as a core is covered by a shell resin has been suggested to resolve this problem.

Japanese Patent Application Laid-open No. 2009-163026 suggests a toner using materials with high affinity as the resins constituting the core and the shell, those materials having close solubility parameter values (SP values). According to this document, since the core is covered by the shell that has adhered thereto, the wax can be prevented from exude, and heat resistance in storage and stability of the fixed image are improved. However, when the inventors have checked this technique, it was found that under severe conditions such as repeated variations in temperature and moisture environment, exude of the wax still can occur and the exude inhibition effect is insufficient.

Japanese Patent Application Laid-open No. 2010-168522 describes an example in which a compound having an organopolysiloxane structure is used as a toner shell resin. Organopolysiloxane compounds are known as materials typically having a low solubility parameter value (SP value). The inventors have assumed that the presence of such a material with a low SP value on the toner surface will apparently be capable of preventing the wax from exude under the above-mentioned severe conditions. However, with such a technique, the difference between the SP value of the shell resin and the SP value of the core binder resin is increased. As a result, the adhesiveness of the core and the shell is low and a sufficient core-shell structure is not created which is apparently why the core was found to seep out when the technique was verified.

Japanese Patent Application Laid-open No. 2006-91283 suggests a toner of a core-shell structure comprising a binder resin and an organopolysiloxane compound in a shell resin. According to this document, the toner obtained excels in ability to separate from the thermal fixation roll, and an image with long-term stability can be obtained. When the inventors have estimated the toner obtained in this document, the exude of wax was actually found to be inhibited. However, at the same time, low-temperature fixation was found to be difficult. The reason therefor is apparently that since the organopolysiloxane compound is contained in the core, the exude of the wax is also inhibited during the fixation and a cold offset easily occurs. Yet another reason is apparently that the shell resin is used in a large amount of about 20 parts by weight to 60 parts by weight per 100 parts by weight of the core, and the shell phase is thick. Therefore, the core is unlikely to obtain the sufficient amount of heat from the thermal roller during the fixation.

SUMMARY OF THE INVENTION

The present invention provides a toner that resolves the above-described problems inherent to the related art. In the toner which has a core-shell structure, the low-molecular weight components and wax contained in the core are prevented from exude, and excellent stability in storage is ensured, despite a thin shell phase.

Thus, the present invention provides a toner comprising toner particles, wherein each of the toner particles has a core-shell structure composed of a core and a shell phase formed on the core, the shell phase contains a resin (B), and the core contains a binder resin (A), a colorant and a wax, wherein the toner particles contain the resin (B) in an amount equal to or greater than 3.0 parts by weight and equal to or less than 15.0 parts by weight per 100.0 parts by weight of the core, and where a solubility parameter (SP value) of the binder resin (A) is denoted by SP(A) $[(cal/cm^3)^{1/2}]$, an SP value of the resin (B) is denoted by SP(B) $[(cal/cm^3)^{1/2}]$, an SP value of a repeating unit with the smallest SP value from among repeating units constituting the resin (B) is denoted by SP(C) $[(cal/cm^3)^{1/2}]$, and an SP value of the wax is denoted by SP(W) $[(cal/cm^3)^{1/2}]$, SP(A) is equal to or greater than 9.00 $(cal/cm^3)^{1/2}$ and equal to or less than 12.00 $(cal/cm^3)^{1/2}$, SP(W) is equal to or greater than 7.50 $(cal/cm^3)^{1/2}$ and equal to or less than 9.50 $(cal/cm^3)^{1/2}$, and each of SP(A), SP(B), SP(C) and SP(W) satisfy relationships represented by Formulas (1) and (2) below:

$$0.00<\{SP(A)-SP(B)\}\leq 2.00 \quad (1); \text{ and}$$

$$0.00<\{SP(W)-SP(C)\}\leq 2.00 \quad (2).$$

According to the present invention, it is possible to provide a toner which has a core-shell structure and in which the low-molecular weight components and wax contained in the core are prevented from exude, and excellent stability in storage is ensured, despite a thin shell phase.

Further features of the present invention will become apparent from the following description of exemplary embodiments (with reference to the attached drawings).

DESCRIPTION OF THE EMBODIMENTS

Figure 1:
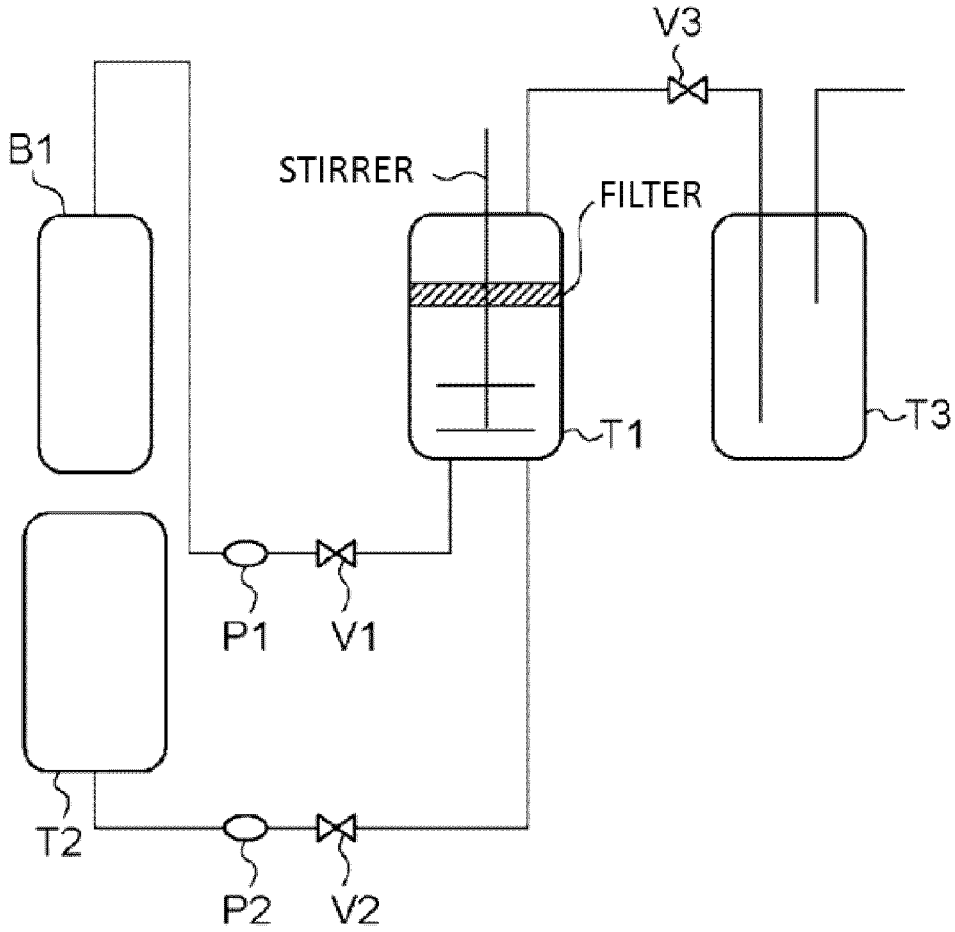
FIG. 1 is a drawing that illustrates an example of the apparatus for manufacturing the toner in accordance with the present invention.

The present invention will be described hereinbelow in greater detail on the basis of the embodiments thereof.

The toner in accordance with the present invention contains toner particles, wherein each of the toner particles has a core-shell structure composed of a core and a shell phase formed on the core, the shell phase contains a resin (B), and the core contains a binder resin (A), a colorant and a wax. The shell phase may cover the core as a layer having a distinct interface or may be in the form such that the core is covered in a state in which no distinct interface is present.

The inventors have found that the adhesiveness of the core and shell can be increased by appropriately designing the relationship between the SP value of the binder resin (A) and the SP value of the resin (B) constituting the shell phase and that the phenomenon of the low-molecular weight components or wax of the core exude to the toner surface can be prevented, even when the toner is allowed to stay in an environment with severe fluctuations in temperature and humidity, by appropriately designing the relationship between the SP value of the repeating unit (this unit can be also referred to hereinbelow simply as "unit (C)") with the smallest SP value, from among the repeating units constituting the resin (B), and the SP value of the wax. Those findings led to the creation of the present invention.

In accordance with the present invention, the SP value (SP(A)) of the binder resin (A), the SP value (SP(B)) of the resin (B), the SP value (SP(C)) of the unit (C), and the SP value (SP(W)) of the wax are determined in the following manner by the calculation method suggested by Fedors.

First, the SP value of the repeating unit constituting the binder resin or the resin (also can be referred to hereinbelow as "resin or the like") is determined in the following manner. In the case where the binder resin or the resin is a vinyl resin (a polymer constituting the resin is produced by polymerization of vinyl monomers), the repeating units constituting the binder resin or the resin as referred to herein mean a molecular structure in a state in which the double bonds of the vinyl monomers are broken by the polymerization.

For example, when the SP value ($\sigma_m$) of the repeating unit is calculated, the evaporation energy ($\Delta ei$) (cal/mol) and the molar volume ($\Delta vi$) ($cm^3$/mol) are determined from the table presented in Polym. Eng. Sci., 14(2), 147-154 (1974) with respect to the atoms or atom associations in the molecular structure of this repeating unit, and calculations are then performed by the following Eq. (6):

$$\sigma_m=(\Sigma\Delta ei/\tau\Delta vi)^{1/2}. \quad \text{Eq. (6)}$$

The SP value ($\sigma_p$) of the resins is calculated by the following Eq. (7) by determining the evaporation energy ($\Delta ei$) and molar volume ($\Delta vi$) of the repeating units constituting the resin for each repeating unit, calculating the products of the determined evaporation energy and molar volume by the molar ratio (j) of each repeating unit in the resin, and dividing the sum total of the evaporation energies of the repeating units by the sum total of molar volumes:

$$\sigma_p=\{(\Sigma j\times\Sigma\Delta ei)/(\Sigma j\times\Sigma\Delta vi)\}^{1/2}. \quad \text{Eq. (7)}$$

For example, when the resin is assumed to be constituted by the repeating units of two types, namely, X and Y, where the composition ratio of each repeating unit is denoted by Wx and Wy (wt %), the molar weight is denoted by Mx and My, the evaporation energy is denoted by $\Delta ei(X)$ and $\Delta ei(Y)$, and the molar volume is denoted by $\Delta vi(X)$ and $\Delta vi(Y)$, the molar ratio (j) of each repeating unit will be Wx/Mx and Wy/My, respectively, the solubility parameter value ($\sigma_p$) of the resin will be represented by Eq. (8) below:

$$\sigma_p=[\{(Wx/Mx)\times\Delta ei(X)+Wy/My\times\Delta ei(Y)\}/\{(Wx/Mx)\times\Delta vi(X)+Wy/My\times\Delta vi(Y)\}]^{1/2}. \quad \text{Eq. (8)}$$

When two or more resins are mixed, the SP value ($\sigma_m$) of the mixture thereof is calculated as a product of the mass composition ratio (Wi) of the mixture and SP value ($\sigma_i$) of each resin by Eq. (9) below:

$$\sigma_m=\Sigma(\mathrm{Wi}\times\sigma_i). \quad \text{Eq. (9):}$$

The toner in accordance with the present invention is designed such that the relationship between the SP value [SP(A)] of the binder resin (A) and the SP value [SP(B)] of the resin (B) is within the range represented by Formula (1) below. As a result, a structure can be formed in which stable adhesiveness is demonstrated between the core and the shell phase and the wax contained in the core is unlikely to seep out to the outside of the toner.

$$\text{(Formula)}: 0.00<\{\mathrm{SP}(A)-\mathrm{SP}(B)\}\leq 2.00 \quad (1)$$

As mentioned hereinabove, the SP value [SP(A)] of the binder resin used in the toner in accordance with the present invention is equal to or greater than 9.00 $(cal/cm^3)^{1/2}$ and equal to or less than 12.00 $(cal/cm^3)^{1/2}$.

When the value of SP(A)−SP(B) is equal to or less than 0.00 $(cal/cm^3)^{1/2}$, the shell phase is likely to be embedded in the core and a uniform core-shell structure is difficult to form. As a result, the exude of the wax and low-molecular weight components of the binder resin occurs and the cohesion of toner particles occurs. Meanwhile, where the value of SP(A)−SP(B) exceeds 2.00, adhesiveness of the core and the shell phase is degraded, the shell phase is separated, and the core-shell structure is difficult to obtain. As a result, in those cases, the exude of the wax and low-molecular weight components of the binder resin (A) occurs. Thus, it is preferred that the value of SP(A)−SP(B) be designed within a range represented by Formula (4) below:

$$\text{(Formula)}: 0.20<\{\mathrm{SP}(A)-\mathrm{SP}(B)\}\leq 1.70 \quad (4).$$

Where the relationship between the SP value [SP(W)] of the wax and the SP value [SP(C)] of the repeating unit [unit (C)] with the smallest SP value from among the repeating units constituting the resin (B) is designed within a range represented by Formula (2) below, the wax is even more effectively prevented from exude to the toner surface:

$$\text{(Formula)}: 0.00<\{\mathrm{SP}(W)-\mathrm{SP}(C)\}\leq 2.00 \quad (2).$$

As described hereinbelow, the SP value [SP(W)] of the wax used in the toner in accordance with the present invention is equal to or greater than 7.50 $(cal/cm^3)^{1/2}$ and equal to or less than 9.50 $(cal/cm^3)^{1/2}$.

When the value of SP(W)−SP(C) is equal to or less than 0.00 $(cal/cm^3)^{1/2}$, the effect of the unit (C) that retains the wax in the toner is reduced, and when the toner is allowed to stay in an environment with particularly significant fluctuations of temperature or humidity, the wax oozes to the toner surface. Such exude results in the aggregation of toner particles. Meanwhile, where the value of SP(W)−SP(C) exceeds 2.00 $(cal/cm^3)^{1/2}$, even the exude of the wax from the toner during the fixation is inhibited and the effect of the wax as a release agent is not sufficiently demonstrated and the fixing performance is degraded. It is thus preferred that the value of SP(W)−SP(C) be designed within the range represented by Formula (5) below:

$$\text{(Formula)}: 0.90 < \{SP(W) - SP(C)\} \leq 2.00 \quad (5).$$

In accordance with the present invention, the aforementioned toner particles contain the resin (B) in an amount of 3.0 parts by weight to 15.0 parts by weight per 100 parts by weight of the core. Where this amount is less than 3.0 parts by weight, the core is insufficiently covered with the resin (B) and the exude of the wax occurs. Meanwhile, where this amount exceeds 15 parts by weight, the shell thickness increases and the exude of the wax during the fixation is inhibited. The aforementioned amount is preferably from 4.0 parts by weight to 10.0 parts by weight.

In the toner in accordance with the present invention, the SP value [SP(B)] of the resin (B), the SP value [SP(C)] of the repeating unit [unit (C)] with the smallest SP value from among the repeating units constituting the resin (B), and the SP value [SP(W)] of the wax preferably satisfy the relationship represented by Formula (3) below. By preparing the toner such as to satisfy the relationship represented by Formula (3) below, it is possible to cause the exude of the wax more effectively during the fixation, while maintaining the effect of inhibiting the exude of the wax during the storage under the above-described environment:

$$\text{(Formula)}: SP(C) < SP(W) < SP(B) \quad (3).$$

The configuration of the toner and the manufacturing method thereof that make it possible to satisfy the requirements of the present invention are described below, but the present invention is not necessarily limited to those toner configuration and manufacturing method.

The binder resin (A) used for the core is not particularly limited and any typical resin that has been used in the conventional toners can be used. Examples of suitable resins contain vinyl resins, polyesters resins, and epoxy resins. Those resins preferably have crystallinity, and the especially preferred among them is a resin that contains as the main component a copolymer in which a segment capable of forming a crystalline structure and a segment incapable of forming a crystalline structure are chemically bonded. The expression "as the main component" used herein means that the content ratio of the copolymer in the binder resin is equal to or higher than 50 wt %. The aforementioned "segment capable of forming a crystalline structure" means a crystalline polymer and is a segment such that where a large number thereof gather together, a polymer chain is orderly arranged and crystallinity is demonstrated. Meanwhile, the aforementioned "segment incapable of forming a crystalline structure" means an amorphous polymer and is a segment such that where a number thereof gather together, no regular arrangement occurs and a random structure is obtained.

Examples of chemically bonded copolymers contain block polymers, graft polymers, and star polymers. Among them, block polymers are especially preferred. A block polymer is a copolymer in which polymers are bonded together by covalent bonds in a molecule.

Examples of the aforementioned block polymer forms include ab-type diblock polymers of a crystalline polymer (a) and an amorphous polymer (b), aba-type triblock polymers, bab-type triblock polymers, and abab . . . -type multiblock polymers. When such a block polymer is used in the binder resin (A), fine domains of the crystalline polymer (a) can be uniformly formed in the binder resin. As a result, the sharp melt property caused by the crystalline polymer (a) is demonstrated by the entire toner and a low-temperature fixing effect can be demonstrated.

The crystalline polymer (a) in the above-mentioned block polymer is described below. In accordance with the present invention, it is more preferred that a polyester having crystallinity (referred to hereinbelow as "crystalline polyester") be used as crystalline polymer (a).

The crystalline polyester, as referred to herein, means a polyester showing a distinct melting peak when the differential heat is measured by differential scanning calorimetry (DSC).

It is preferred that the crystalline polyester use as starting materials an aliphatic diol having 2 to 20 carbon atoms as an alcohol component and a polyhydric carboxylic acid as an acid component. It is preferred that the aliphatic diol be a linear diol. With a linear configuration, a polyester with high crystallinity can be obtained.

Examples of the abovementioned aliphatic diols include the following compounds: 1,2-ethanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,8-octadecanediol, and 1,20-eucosandiol.

Among the aforementioned compounds, from the standpoint of melting point, 1,2-ethanediol, 1,4-butanediol, 1,5-pentanediol, and 1,6-hexanediol are more preferred. Those diols may be used individually or may be also used as a mixture of two or more thereof.

An aliphatic diol having a double bond can be also used. Examples of the aliphatic diols having a double bond include the following compounds: 2-butene-1,4-diol, 3-hexane-1,6-diol, and 4-octene-1,8-diol.

Further, aromatic dicarboxylic acids and aliphatic dicarboxylic acids are preferred as the abovementioned polyhydric carboxylic acids, aliphatic dicarboxylic acids are more preferred among them, and from the standpoint of crystallinity, linear aliphatic dicarboxylic acids are particularly preferred.

Examples of the aliphatic dicarboxylic acids include the following compounds: oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, or lower alkyl esters and anhydrides thereof.

The preferred acids among them include sebacic acid, adipic acid, 1,10-decanedicarboxylic acid, and lower alkyl esters and anhydrides thereof.

Examples of the aromatic dicarboxylic acids include: terephthalic acid, isophthalic acid, 2,6-naphthalenedicarboxylic acid, and 4,4'-biphenyldicarboxylic acid.

Among them, from the standpoint availability and easiness of low-melting polymer formation, terephthalic acid is preferred. Those compounds may be used individually or as a mixture of two or more thereof.

Dicarboxylic acids having a double bond can be also used. With the dicarboxylic acids having a double bond, the entire resin can be crosslinked by using the double bonds, and therefore the acid can be advantageously used to prevent the hot offset during the fixation.

Examples of such dicarboxylic acids include fumaric acid, maleic acid, 3-hexenedioic acid, and 3-octenedioic acid. Lower alkyl esters and anhydrides thereof can be also used. Among them, from the standpoint of cost, fumaric acid and maleic acid are preferred.

A method for manufacturing the crystalline polyester is not particularly limited, and a method for polymerizing typical polyester resins by which an acid component is reacted with an alcohol component can be used. For example, a direct polycondensation method or a transesterification method can be selected according to the types of monomers used.

The crystalline polyester is preferably manufactured at a polymerization temperature between 180° C. and 230° C., and it is preferred that the reaction system be depressurized, as necessary, and the reaction be conducted, while removing water and alcohol generated during the condensation. When the monomers do not dissolve or are incompatible under the reaction temperature, a high-boiling solvent can be added as a dissolution enhancer to induce dissolution. A polycondensation reaction is performed while retaining the dissolution enhancing solvent in the system. When a monomer with poor compatibility is present in the polymerization reaction, it is preferred that the monomer with poor compatibility be condensed in advance with an acid or alcohol that is assumed to polycondense with this monomer and then be polycondensed with the main component.

Examples of catalysts that can be used when the crystalline polyester is manufactured include: titanium catalysts such as titanium tetraethoxide, titanium tetrapropoxide, titanium tetraisopropoxide, and titanium tetrabutoxide, and tin catalysts such as dibutyltin dichloride, dibutyltin oxide, and diphenyltin oxide.

The amorphous polymer (b) in the aforementioned block copolymer is described below.

The amorphous polymer (b) is not particularly limited, provided that it is amorphous, and the polymers similar to the amorphous resins that are typically used as toner resins can be used. However, it is preferred that the glass transition temperature (Tg) of the amorphous polymer (b) be 50° C. to 130° C., preferably 70° C. to 130° C. When such an amorphous polymer (b) is used, the elasticity of the toner in a fixation range after the sharp melt can be easily maintained.

Specific examples of amorphous polymer (b) include polyurethane resins, amorphous polyester resins, styrene acrylic resins, polystyrene, and styrene butadiene resins. Further, those resins bay be also modified by urethane, urea, or epoxy. Among them, from the standpoint of elasticity retention, amorphous polyester resins and polyurethane resins can be advantageously used.

Amorphous polyester resins are described below. Examples of monomers that can be used in the manufacture of amorphous polyester resins include well-known carboxylic acid having two, or three or more carboxyl groups, and alcohols having two, or three or more hydroxyl groups, such as described, for example, in "Kobunshi Data Handbook: Kisohen" (Kobunshi Gakkaihen; Baifukan) ("Polymer Data Handbook: Basic Edition" edited by The Society of Polymer Science, Japan; published by Baifukan. Specific examples of those monomers are presented below.

Examples of divalent carboxylic acids include the following compounds: dibasic acids such as succinic acid, adipic acid, sebacic acid, phthalic acid, isophthalic acid, terephthalic acid, malonic acid, dodecenylsuccinic acid and also anhydrides or low alkyl esters thereof, and aliphatic saturated dicarboxylic acids such as maleic acid, fumaric acid, itaconic acid, and citraconic acid.

Examples of carboxylic acids having three or more carboxyl groups include the following compounds: 1,2,4-benzenetricarboxylic acid, 1,2,5-benzenetricarboxylic acid, and anhydrides or lower alkyl esters thereof. Those compounds may be used individually, or in combinations of two or more thereof.

Examples of dihydric alcohols include the following compounds: bisphenol A, hydrogenated bisphenol A, bisphenol A ethylene oxide or propylene oxide adduct, 1,4-cyclohexanediol, 1,4-cyclohexanedimethanol, ethylene glycol, and propylene glycol.

Examples of alcohols having three or more hydroxyl groups include the following compounds: glycerin, trimethylolethane, trimethylolpropane, and pentaerythritol. Those compounds may be used individually, or in combinations of two or more thereof.

With the object of adjusting the acid value or hydroxyl value, a monovalent acid such as acetic acid and benzoic acid, and a monohydric alcohol such as cyclohexanol and benzyl alcohol can be also used, as necessary.

The amorphous polyester resin can be synthesized by the methods described, for example, in "Jushukugo (Polycondensation)" published by Kagaku Dojin, "Kobunshi Jikkengaku: Jushukugo to Jufuka (Experiments in Polymer Science: Polycondensation and Polyaddition)" published by Kyoritsu Shuppan), or "Polyester Jushi Handbook (Polyester Resin Handbook)" edited by Nikkan Kogyo Shimbun, and transesterification and direct polycondensation can be used individually or in combination.

Polyurethane resins as amorphous polymers will be described below. A polyurethane resin is a reaction product of a diol and a substance including a diisocyanate group, and a resin having functionality of various types can be obtained by adjusting the diol and diisocyanate.

Examples of the diisocyanate component are presented below. Aromatic diisocyanates having 6 to 20 carbon atoms (excluding carbon in the NCO group; same hereinbelow), aliphatic diisocyanates having 2 to 18 carbon atoms, alicyclic diisocyanates having 4 to 15 carbon atoms, and modification products thereof (modification products including an urethane group, a carbodiimide group, an allofarnate group, an urea group, a biuret group, an uretdione group, an uretimine group, an isocyanurate group, or an oxazolidone group; referred to hereinbelow also as "modified diisocyanates"), and mixtures of two or more thereof Examples of the aromatic diisocyanates include m- and/or p-xylylene diisocyanate (XDI) and $\alpha,\alpha,\alpha',\alpha'$,-tetramethylxylylene diisocyanate.

Examples of the aliphatic diisocyanates include ethylene diisocyanate, tetramethylene diisocyanate, hexamethylene diisocyanate (HDI), and dodecamethylene diisocyanate.

Examples of the alicyclic diisocyanates include isophorone diisocyanate (IPDI), dicyclohexylmethane-4,4'-diisocyanate, cyclohexylene diisocyanate, and methylcyclohexylene diisocyanate.

The preferred among them are aromatic diisocyanates having 6 to 15 carbon atoms, aliphatic diisocyanates having 4 to 12 carbon atoms, and alicyclic diisocyanates having 4 to 15 carbon atoms, and the especially preferred are XDI, IPDI, and HDI.

In a polyurethane resin, an isocyanate compound with a functionality of three or more can be used in addition to the diisocyanate component.

Examples of the diol components that can be used in the polyurethane resins include the following compounds: alkylene glycols (ethylene glycol, 1,2-propylene glycol, and 1,3-propylene glycol); alkylene ether glycols (polyethylene glycol and polypropylene glycol); alicyclic diols (1,4-cyclohexane dimethanol); bisphenols (bisphenol A); and alkylene oxide (ethylene oxide and propylene oxide) adducts of the aforementioned alicyclic diols.

The alkyl portion of the aforementioned alkylene glycols and alkylene ether glycols may be linear or branched. In accordance with the present invention, alkylene glycols with a branched structure can be also advantageously used.

Examples of bonds in the block polymers in which the abovementioned crystalline polymer (a) and amorphous polymer (b) are bonded together include ester bonds, urea bonds, and urethane bonds. Among them block polymers with urethane bonds are particularly preferred because they easily maintain the appropriate elasticity even in the fixing temperature region after the sharp melt and can effectively inhibit the high-temperature offset.

A method by which the crystalline polymer (a) and amorphous polymer (b) are separately prepared and then bonded (two-stage method) or a method by which the starting materials of the crystalline polymer (a) and amorphous polymer (b) are charged at the same time and the preparation is performed in one stage (one-stage method) can be used to prepare the block polymer.

The block polymer can be synthesized by selecting an appropriate method from a variety of methods with consideration for the reactivity of end functional groups of each polymer. A specific preparation example of a block copolymer using a crystalline polyester as the crystalline polymer (a) is described below.

A block polymer including a crystalline polyester and an amorphous polyester can be prepared by preparing each unit separately and then bonding by using a bonding agent. In particular, when the acid value of one polyester is high and the hydroxyl value of the other polyester is high, it is not necessary to use a bonding agent, and the condensation reaction can be directly advanced under heating and decompression. In this case, the reaction temperature is preferably about 200° C.

When a bonding agent is used, the examples of suitable bonding agents include polyvalent carboxylic acids, polyhydric alcohols, polyvalent isocyanates, polyfunctional epoxy, and polyacid anhydrides. By using such bonding agents, it is possible to synthesize the block polymer by a dehydration reaction or an addition reaction.

In the case of a block polymer obtained from a crystalline polyester and a polyurethane, the block polymer can be prepared by preparing each unit separately and performing urethanization of the alcohol end of the crystalline polyester and the isocyanate end of the polyurethane. A block polymer can be also synthesized by mixing a crystalline polyester having an alcohol end and a diol and a diisocyanate constituting a polyurethane, and heating. In this case, at the initial stage of the reaction when the concentrations of diol and diisocyanate are high, the diol and diisocyanate react selectively to form a polyurethane, and after the molecular weight reaches a certain value, urethanization of the isocyanate end of the polyurethane and the alcohol end of the crystalline polyester occurs, thereby producing a block polymer.

For the effect of the block polymer to be demonstrated effectively, it is preferred that the presence of the crystalline polymer and amorphous polymer in the binder resin be minimized. Thus, a high block formation ratio is preferred.

In the toner in accordance with the present invention, the content ratio of the crystalline polyester in the binder resin (A) is preferably equal to or higher than 50 wt %. When the binder resin (A) is a block polymer, the composition ratio of the crystalline polyester in the block polymer is preferably equal to or higher than 50 wt %. Where the content ratio of the crystalline polyester is equal to or higher than 50 wt %, the effective sharp melt property can be easily demonstrated. Where the content ratio of the crystalline polyester in the binder resin (A) is less than 50 wt %, the effective sharp melt property is unlikely to be demonstrated and is easily affected by the Tg of the amorphous resin. It is more preferred that the content ratio of the crystalline polyester be equal to or higher than 60 wt %. Meanwhile, the content ratio of the amorphous resin in the binder resin (A) is preferably equal to or higher than 15 wt % of the binder resin (A). Where the content ratio of the amorphous resin is equal to or higher 15 wt %, the elasticity after the sharp melt is effectively maintained. Where the content ratio of the amorphous resin is less than 15 wt %, the elasticity is difficult to maintain after the toner has been sharp melted and a high-temperature offset can occur. It is more preferred that the content ratio of the amorphous resin be equal to or higher than 20 wt %.

Thus, it is preferred that the ratio of the crystalline polyester to the binder resin (A) be equal to or higher than 50 wt % and equal to or lower than 90 wt %, more preferably equal to or higher than 60 wt % and equal to or lower than 85 wt %.

It is preferred that in the block polymer used in accordance with the present invention, the peak temperature of the highest endothermic peak in DSC measurements be within a range from equal to or higher than 50° C. to equal to or lower than 80° C. In this case, the aforementioned highest endothermic peak is derived from the polyester component, and the peak temperature indicates the melting point of the polyester component.

The solubility parameter (SP value) of the binder resin [SP(A)] used in the toner in accordance with the present invention is equal to or greater than 9.00 $(cal/cm^3)^{1/2}$ and equal to or less than 12.00 $(cal/cm^3)^{1/2}$. This SP(A) indicates the range of solubility parameter of typical binder resins that are used in the conventional toners.

The resin forming the shell phase in the toner in accordance with the present invention is described below.

In accordance with the present invention, the shell phase contains the aforementioned resin (B), but the shell phase can be also formed by additionally using other resins (D). The other resins (D) are described below.

The toner particles in accordance with the present invention contain the resin (B) in an amount equal to or greater than 3.0 parts by weight and equal to or less than 15.0 parts by weight per 100.0 parts by weight of the core. Where the amount of the resin (B) is less than 3.0 parts by weight, the amount of the resin (B) present on the surface is insufficient and aggregation of toner particles occurs due to the exude of the wax or low-molecular weight components of the binder resin. When the amount of the resin (B) is higher than 15.0 parts by weight, the shell phase increases in thickness, thereby inhibiting the low-temperature fixability.

The resin (B) used in accordance with the present invention is described below.

The SP value [SP(B)] of the resin (B) is preferably equal to or greater than 7.00 $(cal/cm^3)^{1/2}$ and less than 12.00 $(cal/cm^3)^{1/2}$. Where the SP(B) is designed to be within this range, Formula (1), which is a means for attaining the object of the present invention, can be satisfied. It is more preferred that the SP(B) be within a range of equal to or greater than 7.30 $(cal/cm^3)^{1/2}$ and less than 12.00 $(cal/cm^3)^{1/2}$, even more preferably within a range of equal to or greater than 8.00 $(cal/cm^3)^{1/2}$ and less than 11.00 $(cal/cm^3)^{1/2}$. Where the SP(B) is designed to be within this range, Formula (3) can be satisfied.

Examples of resins suitable as the resin (B) include vinyl resins, urethane resins, epoxy resins, ester resins, polyamides, polyimides, silicone resins, fluororesins, phenolic resins, melamine resins, benzoguanamine resins, urea resins, aniline resins, ionomer resins, polycarbonates, cellulose, and mixtures thereof. Among them, vinyl resins are preferred.

The resin (B) is preferably a copolymer including a plurality of repeating units as constituent components. The SP value [SP(C)] of the repeating unit [unit (C)] with the smallest SP value from among the plurality of repeating units is preferably equal to or greater than 5.50 $(cal/cm^3)^{1/2}$ and less than 9.50 $(cal/cm^3)^{1/2}$. Where the SP(C) is designed to be within this range, Formula (2), which is a means for attaining the object of the present invention, can be satisfied. It is more preferred that the SP(C) be within a range of equal to or greater than 5.50 $(cal/cm^3)^{1/2}$ and less than 9.00 $(cal/cm^3)^{1/2}$, even more preferably within a range of equal to or greater than 5.50 $(cal/cm^3)^{1/2}$ and less than 8.60 $(cal/cm^3)^{1/2}$, and still more preferably within a range of equal to or greater than 6.00 $(cal/cm^3)^{1/2}$ and less than 8.60 $(cal/cm^3)^{1/2}$. Where the SP(C) is designed to be within this range, Formula (4) can be satisfied.

Further, the resin (B) is preferably a vinyl resin obtained by copolymerizing a monomer providing the repeating unit [unit (C)] with the smallest SP value from among the repeating units constituting the resin (B), and another vinyl monomer at a weight ratio of 5:95 to 20:80.

The unit (C) is, for example, a repeating unit having an alkyl group with 6 or more carbon atoms, an alkylene oxide group, a perfluoroalkyl group, or a polysiloxane structure in a molecule. Among such repeating units, a vinyl unit (referred to hereinbelow as "silicone unit") having bound thereto an organopolysiloxane structure and represented by General Formula (I) below is preferred.

General Formula (I)

[Chem. 1]

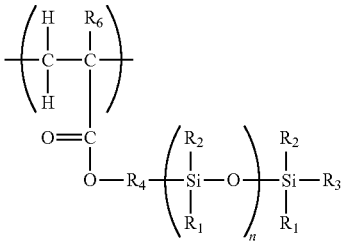

In General Formula (I), $R_1$, $R_2$, and $R_3$ represent alkyl groups having a linear or branched chain with 1 to 5 carbon atoms. A methyl group is preferred. $R_4$ is an alkylene group having 1 to 10 carbon atoms, and $R_5$ is a hydrogen atom or a methyl group. n is an integer from 2 to 200, more preferably from 3 to 200, even more preferably from 3 to 15.

The resin (B) is preferably obtained by copolymerization of the monomer (referred to hereinbelow as "silicone monomer") providing the silicone unit and another vinyl monomer.

Monomers of the usual resin materials can be used as the other vinyl monomer.

Examples thereof are presented below, but those examples are not limiting.

Esters of vinylic acids and alcohols: for example, alkyl acrylates and alkyl methacrylates having an alkyl group (straight or branched) with 1 to 26 carbon atoms (methyl acrylate, methyl methacrylate, ethyl acrylate, ethyl methacrylate, propyl acrylate, propyl methacrylate, butyl acrylate, butyl methacrylate, behenyl acrylate, behenyl methacrylate, 2-ethylhexyl acrylate, 2-ethylhexyl methacrylate), phenyl acrylate, phenyl methacrylate, α-ethoxyacrylate, dialkyl fumarates (dialkyl esters of fumaric acid) (two alkyl groups are straight-chain, branched-chain, or cyclic groups having 2 to 8 carbon atoms), dialkyl maleates (dialkyl ester of maleic acid) (two alkyl groups are straight-chain, branched-chain, or cyclic groups having 2 to 8 carbon atoms), cyclohexyl methacrylate, benzyl methacrylate, vinyl monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is abbreviated hereinbelow as EO) 10 mol adduct acrylate, methyl alcohol ethylene oxide (ethylene oxide is abbreviated hereinbelow as EO) 10 mol adduct methacrylate, lauryl alcohol EO 30 mol adduct acrylate, and lauryl alcohol EO 30 mol adduct methacrylate).

Esters of vinyl alcohol and acids: for example, esters of vinyl alcohol and fatty acids having an alkyl group (straight-chain or branched) with 1 to 8 carbon atoms (vinyl acetate, vinyl propionate, vinyl butyrate, and vinyl valerate), diallyl phthalate, diallyl adipate, isopropenyl acetate, vinyl methacrylate, methyl-4-vinyl benzoate, vinyl methoxyacetate, vinyl benzoate, and polyallyloxyalkanes (diallyloxyethane, triallyloxyethane, tetraallyloxyethane, tetraallyloxypropane, tetraallyloxybutane and tetramethallyloxyethane).

Polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate.

Aromatic vinyl monomers can be also used. Examples of suitable aromatic vinyl monomers include styrene and hydrocarbyl (alkyl, cycloalkyl, aralkyl and/or alkenyl) substituents thereof, for example, α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene, and vinylnaphthalene.

Carboxylated vinyl monomers and metal salts thereof can be also used. Examples of the carboxylated vinyl monomers and metal salts thereof include C3 to C30 unsaturated monocarboxylic acids, unsaturated dicarboxylic acids, anhydrides thereof, and monoalkyl (1 to 27 carbon atoms) esters thereof, for example, acrylic acid, methacrylic acid, maleic acid, maleic anhydride, monoalkyl esters of maleic acid, fumaric acid, monoalkyl esters of fumaric acid, crotonic acid, itaconic acid, monoalkyl esters of itaconic acid, glycol monoether of itaconic acid, citraconic acid, monoalkyl esters of citraconic acid, cinnamic acid, and metal salts thereof.

Further, vinyl monomers having polyester segments capable of forming a crystalline structure (referred to hereinbelow as "crystalline-polyester-modified monomers") also can be advantageously used. The segments capable of forming a crystalline structure, as referred to herein, are segments that are arranged regularly and demonstrate crystalline properties when a large number thereof is collected together, that is, a crystalline polyester. The crystalline polyester can be prepared by using an aliphatic diol and a polyhydric carboxylic acid, same as those of the starting material of the crystalline polymer (a) of the block polymer used as the above-described binder resin (A).

The melting point of the crystalline polyester is preferably equal to or higher than 50° C. and equal to or lower than 120° C. With consideration for melting at a fixation temperature, it is preferred that the melting point be equal to or higher than 50° C. and equal to or lower than 90° C. The number-average molecular weight (Mn) of the crystalline polyester determined by gel permeation chromatography (GPC) of tetrahydrofuran (THF) solubles is preferably equal to or higher than 500 and equal to or lower than 20,000, the weight-average molecular weight (Mw) is preferably equal to or higher than 1,000 and equal to or lower than 40,000.

The crystalline-polyester-modified monomer can be manufactured by performing an urethanization reaction of the crystalline polyester and a hydroxylated vinyl monomer with diisocyanate, thereby introducing a radical-polymerizable unsaturated group into the polyester chain and producing a monomer having urethane bonds. For this purpose, it is preferred that the crystalline polyester be an alcohol-terminated polyester. Therefore, it is preferred that in the preparation of the crystalline polyester, the molar ratio of the alcohol component and acid component (alcohol component to carboxylic acid component) be equal to or greater than 1.02 and equal to or less that 1.20.

Examples of the hydroxylated vinyl monomers include hydroxystyrene, N-methylolacrylamide, N-methylolmethacrylamide, hydroxyethyl acrylate, hydroxyethyl methacrylate, hydroxypropyl acrylate, hydroxypropyl methacrylate, polyethylene glycol monoacrylate, polyethylene glycol monomethacrylate, allyl alcohol, methallyl alcohol, crotyl alcohol, isocrotyl alcohol, 1-butene-3-ol, 2-butene-1-ol, 2-butene-1,4-diol, propalgyl alcohol, 2-hydroxyethylpropenyl ether, and sucrose allyl ester. Among them, hydroxyethyl acrylate and hydroxyethyl methacrylate are preferred.

The diisocyanate same as that of the starting material of the polyurethane used as the amorphous polymer (b) of the block polymer used for the above-described binder resin (A) can be used as the abovementioned diisocyanate.

It is even more preferred that the resin (B) used in accordance with the present invention be a vinyl resin obtained by copolymerizing the above-described monomer that provides a silicone unit with another vinyl monomer at a weight ratio of 5:95 to 20:80. Where the weight ratio is within this range, an appropriate amount of the organic polysiloxane structure is present in the resin (B), storage stability of the toner is improved due to wax exude inhibition, and low-temperature fixability is advantageously maintained. Where the weight of the monomer providing silicone unit is less than 5, aggregation of toner particles caused by wax seeping tends to occur easily. Where the weight ratio is higher than 20, melting of the binder resin and wax during the fixation is easily suppressed and the toner fixing performance tends to decrease.

The resin (D) that is used together with the resin (B) forming the shell phase in the toner in accordance with the present invention is described below. The resin (D) can be a crystalline resin or an amorphous resin. Resins of both types also can be used together. The aforementioned crystalline polyester and also crystalline alkyl resins can be used as the aforementioned crystalline resin.

The crystalline alkyl resin as referred to herein is a vinyl resin obtained by polymerization of an alkyl acrylate and an alkyl methacrylate having 12 to 30 carbon atoms required to demonstrate crystallinity. A resin obtained by copolymerizing the abovementioned vinyl monomers to an extent such that the crystallinity is not lost can be also considered as the aforementioned crystalline alkyl resin.

Examples of the amorphous resins include polyurethane resins, polyester resins, and vinyl resins such as styrene acrylic resins and polystyrene, but this list is not limiting. Those resins may be also subjected to urethane, urea, or epoxy modification.

When the amorphous resin is used as the resin (D) in accordance with the present invention, the glass transition temperature (Tg) of the resin is preferably equal to or higher than 50° C. and equal to or lower than 130° C., more preferably equal to or higher than 50° C. and equal to or lower than 100° C.

When toner particles are manufactured by using the below-described carbon dioxide in a liquid state or a supercritical state as a dispersion medium, it is preferred that the aforementioned resins forming the shell phase in accordance with the present invention do not dissolve in the dispersion medium. Therefore, a crosslinked structure may be introduced in the resins.

When the resin (D) is also used as the resin forming the shell phase in accordance with the present invention, the ratio thereof is not particularly limited, but it is preferred that the ratio of the resin (B) be equal to or greater than 50 wt % in the total amount of the resins forming the shell phase, and it is particularly preferred that no resin other than the resin (B) be used for the shell phase. Where the content ratio of the resin (B) is less than 50 wt %, the possibility of demonstrating the exude inhibiting effect is reduced. The weight-average molecular weight (Mw) of the resin forming the shell phase in accordance with the present invention, as determined by gel permeation chromatography (GPC) of tetrahydrofuran (THF) solubles is preferably equal to or higher than 10,000 and equal to or lower than 150,000. Where the weight-average molecular weight is within this range, the shell phase has a suitable hardness and the durability thereof increases. Where the weight-average molecular weight is less than 10,000, the durability tends to decrease, and where the weight-average molecular weight is higher than 150,000, the fixing performance tends to decrease.

Waxes that are used in typical toner particles can be used in the toner in accordance with the present invention. Examples thereof are listed below, but those examples are not limiting.

Aliphatic hydrocarbon waxes such as low-molecular-weight polyethylene, low-molecular-weight polypropylene, low-molecular-weight olefin copolymers, microcrystalline wax, paraffin wax, and Fischer-Tropsch wax; oxides of aliphatic hydrocarbon waxes such as oxidized polyethylene wax; waxes including a fatty acid ester as the main component, such as aliphatic hydrocarbon ester waxes; waxes obtained by partial or complete deoxidation of fatty acid esters, such as deoxidized carnauba wax; products of partial esterification of fatty acids and polyhydric alcohols, such as monoglyceride behenate; and methyl ester compounds having a hydroxyl group that are obtained by hydrogenation of vegetable oils and fats.

Among those waxes, from the standpoint of exude from the toner during the fixation and releaseability, aliphatic hydrocarbon waxes and ester waxes are preferred.

The ester wax may have at least one ester bond in a molecule and may be a natural ester wax or a synthetic ester wax.

Examples of synthetic ester waxes include monoester waxes synthesized from long-chain linear saturated fatty acids and long-chain linear saturated aliphatic alcohols. The long-chain linear saturated fatty acids are represented by the general formula $C_nH_{2n+1}COOH$, and the acids with n=5 to 28 are preferably used. The long-chain linear saturated aliphatic alcohols are represented by $C_nH_{2n+1}OH$, and the alcohols with n=5 to 28 are preferably used. Examples of the natural ester waxes include candelilla wax, carnauba wax, rice wax, and derivatives thereof.

The range of the SP value [SP(W)] of the wax used in the toner in accordance with the present invention is equal to or greater than 7.50 $(cal/cm^3)^{1/2}$ and equal to or less than 9.50 $(cal/cm^3)^{1/2}$. Concerning the SP value of the aforementioned natural waxes, the SP value of the molecule with the lowest SP value, from among the molecules with a content ratio in the wax component that is equal to or greater than 10 wt %, is taken as the SP value of the wax. Where the SP(W) is less than 7.50 $(cal/cm^3)^{1/2}$, the wax can easily seep to the toner surface, thereby causing aggregation of the toner particles. Where the SP(W) exceeds 9.50 $(cal/cm^3)^{1/2}$, the release effect of the wax is unlikely to be demonstrated during the fixation and the fixation performance is degraded. The preferred range for the SP(W) is from equal to or greater than 8.50 $(cal/cm^3)^{1/2}$ to equal to or less than 9.50 $(cal/cm^3)^{1/2}$. Examples of waxes that satisfy this condition are ester waxes having three or more ester bonds in a molecule. Ester waxes with a functionality of three or more can be obtained, for example, by condensation of an acid with a functionality of three or more and a long-chain linear saturated alcohol, or by synthesis of an alcohol with a functionality of three or more and a long-chain linear saturated fatty acid.

The following acids can be used as the aforementioned long-chain linear saturated fatty acids: caproic acid, caprylic acid, octylic acid, nonylic acid, decanoic acid, dodecanoic acid, lauric acid, tridecanoic acid, myristic acid, palmitic acid, stearic acid, and behenic acid, but this list is not limiting. From the standpoint of the melting point of the wax, myristic acid, palmitic acid, stearic acid, and behenic acid are preferred. The abovementioned long-chain linear saturated fatty acids can be sometimes also used as a mixture.

Trimellitic acid and butanetetracarboxylic acid are examples of the aforementioned acids with a functionality of three or more, but this list is not limiting. The acids with a functionality of three or more can be sometimes also used as a mixture.

The following long-chain linear saturated alcohols can be used: capryl alcohol, lauryl alcohol, myristyl alcohol, palmityl alcohol, stearyl alcohol, and behenyl alcohol, but this list is not limiting. From the standpoint of the melting point of the wax, myristyl alcohol, palmityl alcohol, stearyl alcohol, and behenyl alcohol are preferred. The abovementioned long-chain linear saturated alcohols can be sometimes also used as a mixture.

Examples of the aforementioned alcohols with a functionality of three or more include: glycerol, trimethylolpropane, erythritol, pentaerythritol, and sorbitol, but this list is not limiting. The abovementioned alcohols with a functionality of three or more can be sometimes also used as a mixture. Examples of condensates thereof include the so-called polyglycerols such as diglycerol, triglycerol, tetraglycerol, hexaglycerol, and decaglycerol obtained by condensation of glycerol, ditrimethylolpropane, tristrimethylolpropane obtained by condensation of trimethylolpropane, and dipentaerythritol and trispentaerythritol obtained by condensation of pentaerythritol. Among them, pentaerythritol or dipentaerythritol having a branched structure is preferred, and dipentaerythritol is especially preferred.

The aforementioned wax preferably has a peak temperature within a range from equal to or higher than 60° C. to equal to or lower than 85° C. in the highest endothermic peak measured by DSC measurements. In this case, the abovementioned peak temperature indicates the melting point of the wax. Where the peak temperature is less than 60° C., the low-molecular weight component of the wax tends to seep easily. Meanwhile, where the peak temperature is higher than 85° C., the wax is unlikely to melt adequately during the fixation, and the low-temperature fixability and offset resistance tend to decrease. The peak temperature of the highest endothermic peak of the wax is preferably from equal to or higher than 65° C. to equal to or lower than 80° C.

In accordance with the present invention, it is preferred that the toner particles contain the wax in an amount equal to or greater than 2.0 parts by weight and equal to or less than 20.0 parts by weight in 100.0 parts by weight of the core.

In the toner in accordance with the present invention, the toner particles contain a colorant for imparting a tinting strength. Examples of suitable colorants include organic pigments, organic dyes, inorganic pigments, carbon black as a black colorant, and magnetic powders. Colorants that have been used in the conventional toners can be used.

Examples of suitable yellow colorants include: condensed azo compounds, isoindolinone compounds, anthraquinone compounds, azo metal complexes, methine compounds, and allylamide compounds. More specifically, C. I. Pigment Yellow 12, 13, 14, 15, 17, 62, 74, 83, 93, 94, 95, 109, 110, 111, 128, 129, 147, 155, 168, and 180 can be advantageously used.

Examples of suitable magenta colorants include: condensed azo compound, diketopyrrolopyrrole compounds, anthraquinone, quinacridone compounds, basic dye lake compounds, naphthol compounds, benzimidazolone compounds, thioindigo compounds, and perylene compounds. More specifically, C. I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Examples of suitable cyan colorants include: copper phthalocyanine compounds and derivatives thereof, anthraquinone compounds, and basic dye lake compounds. More specifically, C. I. Pigment Blue 1, 7, 15, 15:1, 15:2, 15:3, 15:4, 60, 62, and 66 can be used.

Those colorants can be used individually or as a mixture, and also as a solid solutions. The colorant to be used is selected on the basis of hue angle, chroma, lightness, lightfastness, OHP transparency, and dispersivity in the toner composition.

The content of the colorant is preferably equal to or greater than 1.0 part by weight and equal to or less than 20.0 parts by weight per 100.0 parts by weight of the binder resin contained in the core. When carbon black is used as the black colorant, it is also preferred that carbon black be added in an amount equal to or greater than 1.0 part by weight and equal to or less than 20.0 parts by weight per 100.0 parts by weight of the binder resin contained in the core.

When the toner particles are manufactured in an aqueous medium, it is preferred that the colorants be selected with consideration also for the aqueous phase transfer ability, and it is also preferred that the colorants be subjected, as necessary to surface modification such as hydrophobic treatment. Meanwhile in addition to the treatment similar to that of the abovementioned dyes, carbon black may be also subjected to a graft treatment with a substance that reacts with surface functional groups of carbon black, for example, a polyorganosiloxane. Further, when a magnetic powder is used as the black colorant, the added amount thereof is preferably equal to or greater than 40.0 parts by weight and equal to or less than 150.0 parts by weight per 100.0 parts by weight of the binder resin contained in the core.

The magnetic power includes as the main component an iron oxide such as triiron tetroxide and γ-iron oxide and typically demonstrates hydrophility. Therefore, when toner particles are manufactured in an aqueous medium, the magnetic powder tends to shift to the toner particle surface due to interaction with water, and the toner particles thus obtained tend to lack flowability and uniformity of triboelectric charging due to the magnetic powder exposed on the surface thereof. Therefore, it is preferred that the magnetic powder be subjected to uniform hydrophobic treatment on the surface with a coupling agent. Examples of coupling agents that can be used include silane coupling agents and titanium coupling agents, and silane coupling agents can be used especially advantageously.

A charge control agent may be introduced, as necessary, into the toner particles in the toner in accordance with the present invention. Alternatively the charge control agent may be externally added to the toner particles. By compounding the charge control agent, it is possible to stabilize the charge characteristics and control the optimum triboelectric charge quantity corresponding to the development system.

Well-known compounds can be used as the charge control agent, and a charge control agent with a high charging speed that can stably maintain a constant charge quantity is especially preferred.

Organometallic compound and chelate compounds are effective as charge control agents that control the toner to a negative charge, examples thereof including monoazo metal compounds, acetyl acetone metal compounds, and metal compounds of aromatic hydroxycarboxylic acid, aromatic dicarboxylic acid, oxycarboxylic acid, and dicarboxylic acid systems. Examples of charge control agents that control the toner to a positive charge include nigrosine, quaternary ammonium salts, metal salts of higher fatty acids, diorganotin borates, guanidine compounds, and imidazole compounds.

The preferred compounded amount of the charge control agents is equal to or greater than 0.01 parts by weight and equal to or less than 20.0 parts by weight, more preferably equal to or greater than 0.5 parts by weight and equal to or greater than 10.0 parts by weight per 100.0 parts by weight of the binder resin contained in the core.

In accordance with the present invention, various methods for forming a core-shell structure can be used to manufacture the toner particles. The formation of the shell phase may be performed simultaneously with the process of forming the core, or after the core has been formed. From the standpoint of simplifying the process, it is preferred that the core manufacturing step and shell phase formation step be performed simultaneously.

A method for forming the shell phase is not particularly limited. For example, when the shell phase is provided after the core has been formed, a method can be used by which fine resin particles forming the core and the shell phase are dispersed in an aqueous medium and then the fine resin particles are aggregated and adsorbed on the core surface. The toner particles in accordance with the present invention are preferably manufactured in a medium of a nonaqueous system. Where a nonaqueous system is used, the unit (C) constituting the resin (B) is easier oriented at the surface, the probability of the wax or core being exposed at the toner surface during granulation is reduced, and stability in storage is increased.

In accordance with the present invention, it is preferred that the toner particles be formed by dispersing a resin composition in which the binder resin (A), the colorant, and the wax are dissolved or dispersed in a medium containing an organic solvent, in a dispersion medium in which fine resin particles including the resin (B) are dispersed and which contains carbon dioxide in a supercritical state or a liquid state, and by removing the organic solvent from the obtained dispersion. Thus, with such a method, the resin composition is dispersed in a dispersion medium which has carbon dioxide in a supercritical state or a liquid state, granulation is performed, the organic solvent contained in the particles after the granulation is removed by extraction to the carbon dioxide phase, and the pressure is then released to separate carbon dioxide and obtain the toner particles. The liquid carbon dioxide as referred to herein is carbon dioxide under temperature and pressure conditions within a zone bounded by a gas-liquid boundary line passing through a triple point (temperature=−56.6° C., pressure=0.518 MPa) and a critical point (temperature=31.3° C., pressure=7.38 MPa), a critical temperature isotherm, and a solid-liquid boundary line on the phase diagram of carbon dioxide. "Carbon dioxide in a supercritical state" as referred to herein represents carbon dioxide under temperature and pressure conditions on or above a critical point of the abovementioned carbon dioxide. The dispersion medium preferably has carbon dioxide as the main component (amount equal to or greater than 50 wt %).

In accordance with the present invention, an organic solvent may be contained as another component in the dispersion medium. In this case, it is preferred that carbon dioxide and the organic solvent form a homogeneous phase.

A method for manufacturing toner particles by using carbon dioxide in a liquid state or a supercritical state as the dispersion medium, which is advantageous for obtaining the toner particles in accordance with the present invention, will be explained below.

First, a colorant, wax, and, if necessary, other additives are added to an organic medium that can dissolve the binder resin and homogeneously dissolved or dispersed with a dispersing unit such as a homogenizer, a ball mill, a colloid mill, and an ultrasonic dispersion unit.

The solution or dispersion thus obtained (referred to hereinbelow simply as "resin composition") is dispersed in carbon dioxide in a liquid state or a supercritical state to form oil droplets.

In this case, a dispersant should be dispersed in the carbon dioxide in a liquid state or a supercritical state serving as the dispersion medium. The resin (B) for forming the shell phase can be used as the dispersant, or other components may be admixed as a dispersant. For example, inorganic fine particle dispersants, organic fine particle dispersants, or mixtures thereof may be used, and two or more thereof may be used together according to the object. Examples of inorganic fine particle dispersants include alumina, zinc oxide, titania, and calcium oxide.

Examples of suitable organic fine particle dispersants other than the aforementioned resin (B) include vinyl resins, urethane resins, epoxy resins, ester resins, polyamides, polyimides, silicone resins, fluororesins, phenolic resins, melamine resins, benzoguanamine resins, urea resins, aniline resins, ionomer resins, polycarbonates, cellulose, and mixtures thereof.

Those dispersants may be used without modification or may be surface modified by a variety of treatment methods in order to improve the adsorption ability on the oil droplet surface during granulation. More specifically, surface treatment with a coupling agent of a silane system, titanate system, or aluminate system, surface treatment with various surfactants, and coating with a polymer can be used.

The organic fine particles in the form of a dispersant adsorbed on the surface of oil droplets remains as they are even after the toner particles have been formed. Therefore, the resin (B) and other resins used as the dispersant form a shell phase on the toner particles.

The particle diameter of the fine resin particles including the resin (B) is preferably equal to or greater than 30 nm and equal to or less than 300 nm, more preferably equal to or greater than 50 nm and equal to or less than 200 nm when calculated as a volume-average particle diameter. Where the particle diameter of the fine resin particles is too small, the stability of oil droplets during granulation tends to decrease. Meanwhile when the fine resin particles are too large, the particle diameter of oil droplets is difficult to control to the desired value.

In accordance with the present invention, any suitable method may be used for dispersing the dispersant in the carbon dioxide in a liquid state or a supercritical state. As a specific example, a method can be used by which the dispersant and carbon dioxide in a liquid state or a supercritical state are charged into a container and the dispersant is directly dispersed by agitation or ultrasonic irradiation. Further, a method can be used by which a dispersion in which the dispersant is dispersed in an organic solvent is introduced by using a high-pressure pump into a container into which the carbon dioxide in a liquid state or a supercritical state has been charged.

Further, in accordance with the present invention, any suitable method can be used for dispersing the resin composition in the carbon dioxide in a liquid state or a supercritical state. As a specific example, a method can be used by which the resin composition is introduced by using a high-pressure pump into a container into which carbon dioxide in a liquid state or a supercritical state having the dispersant dispersed therein has been loaded. It is also possible to introduce carbon dioxide in a liquid state or a supercritical state having the dispersant dispersed therein into a container into which the resin composition has been charged.

In accordance with the present invention, it is important that the dispersion medium constituted by the carbon dioxide in a liquid state or a supercritical state be a single phase. When granulation is performed by dispersing the resin composition in the carbon dioxide in a liquid state or a supercritical state, part of the organic solvent contained in the oil droplets is transferred into the dispersion. In this case, the presence of separated phases of carbon dioxide and organic solvent is undesirable because it results in a loss of stability of the oil droplets. Therefore, it is preferred that the temperature and pressure of the dispersion medium and the amount of the resin composition related to the carbon dioxide in a liquid state or a supercritical state be adjusted within a range in which the carbon dioxide and organic solvent form a homogeneous phase.

Concerning the temperature and pressure of the dispersion medium, an attention should be paid to the granulation ability (easiness of oil droplet formation) and solubility of the constituent components of the resin composition in the dispersion medium. For example, the binder resin and wax contained in the resin composition can be dissolved in the dispersion medium under certain temperature and pressure conditions. Usually, where the temperature and pressure are low, the solubility of the aforementioned components in the dispersion medium can be inhibited, but in this case the oil droplets that have been formed can easily aggregate or coalesce, thereby degrading the granulation ability. Meanwhile, where the temperature and pressure are high, the granulation ability is improved, but the aforementioned components can be easily dissolved in the dispersion medium.

Therefore, in the manufacture of the toner particles in accordance with the present invention, it is preferred that the temperature of the dispersion medium be within a temperature range equal to or higher than 10° C. to equal to or lower than 40° C.

Further, the pressure inside the container where the dispersion medium is formed is preferably equal to or higher than 1.0 MPa and equal to or lower than 20.0 MPa, more preferably equal to or higher than 2.0 MPa and equal to or lower than 15.0 MPa. In the case where components other than carbon dioxide are contained in the dispersion medium, the pressure as referred to in the present invention is the total pressure.

Further, the content ratio of carbon dioxide in the dispersion medium in the present invention is preferably equal to or greater than 70.0 wt %, more preferably equal to or greater than 80.0 wt %, and even more preferably equal to or greater than 90 wt %.

The organic solvent remaining in the oil droplets after the granulation has been completed is removed via the dispersion medium constituted by carbon dioxide in a liquid state or a supercritical state. More specifically, carbon dioxide in a liquid state or a supercritical state is additionally mixed with the dispersion medium in which the oil droplets are dispersed, the remaining organic solvent is extracted into the carbon dioxide, and the carbon dioxide including the organic solvent is then substituted with carbon dioxide in a liquid state or a supercritical state.

Mixing of the dispersion medium and the carbon dioxide in a liquid state or a supercritical state may be performed by adding carbon dioxide in a liquid state or a supercritical state that is higher in pressure than the dispersion medium to the dispersion medium, or by adding carbon dioxide in a liquid state or a supercritical state that is lower in pressure than the dispersion medium to the dispersion medium.

The carbon dioxide including the organic solvent can be further substituted with the carbon dioxide in a liquid state or a supercritical state by causing the carbon dioxide in a liquid state or a supercritical state to circulate, while maintaining a constant pressure in the container. In this process, the toner particles formed are trapped by a filter.

Where the substitution with the carbon dioxide in a liquid state or a supercritical state is insufficient and the organic solvent remains in the dispersion medium, condensation of the organic solvent dissolved in the dispersion medium and re-dissolution of the toner particles can occur when the container is depressurized to recover the obtained toner particles, or the toner particles can coalesce. Therefore, in order to avoid such inconveniences, it is necessary that the substitution with the carbon dioxide in a liquid state or a supercritical state be performed till the organic solvent is completely removed. The amount of the circulating carbon dioxide in a liquid state or a supercritical state is larger than the volume of the dispersion medium by a factor preferably equal to or greater than 1 and equal to or less than 100, more preferably equal to or greater than 1 and equal to or less than 50, and most preferably equal to or greater than 1 and equal to or less than 30.

When the container is depressurized and the toner particles are retrieved from the dispersion including the carbon dioxide in a liquid state or a supercritical state having the toner particles dispersed therein, the temperature and pressure may be reduced in a single cycle to the normal temperature and pressure, and the decompression may be performed in a stepwise manner by providing containers with individually controlled pressure in a multiplicity of stages. The decompression rate is preferably set within a range in which the toner particles are not foamed.

The organic solvent or carbon dioxide used in accordance with the present invention can be recycled.

In the toner in accordance with the present invention, inorganic fine powder can be externally added to the toner particles. The inorganic fine powder has a function of improving the toner flowability and a function of improving the uniformity of toner charge.

Fine powders such as a silica fine powder, a titanium oxide fine powder, an alumina fine powder, and fine powders of composite oxides thereof can be used as the abovementioned inorganic fine powder. Among those inorganic fine powders, a silica fine powder and a titanium oxide fine powder are preferred.

Dry silica or fumed silica produced by vapor phase oxidation of a silicon halide, and dry silica manufactured form water glass can be used as the silica fine powder. The dry silica with a small content of $Na_2O$ and $SO_3^{2-}$ and a small number of silanol groups present on the surface and inside the silica fine powder is preferred as the inorganic fine powder. The dry silica may be also a composite fine powder of silica and another metal oxide that is manufactured by using a metal halide such as aluminum chloride and titanium chloride together with silicon halide in the manufacturing process.

Further, an inorganic fine powder subjected to hydrophobic treatment is preferably used as the aforementioned inorganic fine powder because by subjecting the inorganic fine powder itself to a hydrophobic treatment, it is possible to adjust the charge amount of the toner, improve environmental stability, and improve properties under a high-humidity environment. Where the inorganic fine powder that has been externally added to the toner absorbs moisture, the charge amount of the toner decreases and the development ability and transferability are easily degraded.

Examples of treatment agents for the hydrophobic treatment of the inorganic fine powder include non-modified silicone varnish, various modified silicone varnishes, non-modified silicone oil, various modified silicone oils, silane compounds, silane coupling agents, and other organosilicon compounds and organotitanium compounds. Those treatment agents may be used individually or in combinations.

Among them, an inorganic fine powder treated with silicone oil is preferred. It is more preferred that simultaneously with the hydrophobic treatment performed with a coupling agent or thereafter, the inorganic fine powder be treated with silicone oil. This is because the inorganic fine powder subjected to such hydrophobic treatment makes it possible to maintain a high charge amount of the toner even under a high-humidity environment and is beneficial in terms of selective development.

The amount added of the inorganic fine powder is preferably equal to or greater than 0.1 parts by weight and equal to or less than 4.0 parts by weight, more preferably equal to or greater than 0.2 parts by weight and equal to or less than 3.5 parts by weight per 100 parts by weight of the toner particles.

In the toner in accordance with the present invention, the weight-average particle diameter (D4) is preferably equal to or greater than 3.0 μm and equal to or less than 8.0 μm, more preferably equal to or greater than 5.0 μm and equal to or less than 7.0 μm. The toner with such weight-average particle diameter (D4) is preferred because sufficient dot reproducing ability can is ensured, while maintaining good toner handleability. The ratio (D4/D1) of the weight-average particle diameter (D4) and number-average particle diameter (D1) of the obtained toner is preferably equal to or less than 1.25, more preferably equal to or less than 1.20.

Methods for measuring various physical properties of the toner in accordance with the present invention are described below.

<Method for Measuring the Degree of Polymerization of Silicone Monomer n>

The degree of polymerization of the silicone monomer n is measured by 1H-NMR under the following conditions.

Measurement device: FT NMR device JNM-EX400 (JEOL)

Measurement frequency: 400 MHz

Pulse condition: 5.0 μs

Frequency range: 10,500 Hz

Cumulated number: 64

Measurement temperature: 30° C.

Sample: 50 mg of the silicone monomer for measurements is introduced in a sample tube with an inner diameter of 5 mm, heavy chloroform ($CDCl_3$) is added as a solvent, and dissolution is performed in a thermostat at 40° C.

An integration value $S_1$ of a peak (about 0.0 ppm) attributable to hydrogen bonded to the carbon that is bonded to silicon is calculated from the 1H-NMR chart obtained. An integration value $S_2$ of a peak (about 6.0 ppm) attributable to one end hydrogen of a vinyl group is similarly calculated. The degree of polymerization of the silicone monomer n is determined in the following manner by using the integration value $S_1$ and integration value $S_2$. In the equation below, $n_1$ is the number of hydrogen atoms bonded to the carbon that is bonded to silicon. Where $R_1$ and $R_2$ in the general formula (I) are both methyl groups, $n_1$ is 6, and when they are ethyl or higher groups, $n_1$ is 4.

Degree of polymerization of the silicone monomer $n=\{(S_1-n_1)/n_1\}/S_2$

<Method for Measuring the Weight-Average Particle Diameter (D4) and Number-Average Particle Diameter (D1) of Toner>

In accordance with the present invention, the weight-average particle diameter (D4) and number-average particle diameter (D1) of the toner are calculated in the following manner.

A precise particle size distribution meter "Coulter-Counter Multisizer 3" (registered trademark, manufactured by Beckman Coulter, Inc.) based on a pore electric resistance method and equipped with a 100-μm aperture tube is used as a measurement device. The measurement conditions are set and the measurement data are analyzed using the dedicated software "Beckman Coulter Multisizer 3 Version 3.51" (manufactured by Beckman Coulter, Inc.). The measurement is performed with the number of effective measurement channels set to 25,000.

A solution prepared by dissolving reagent grade sodium chloride in ion-exchange water to a concentration of about 1 wt %, for example, "ISOTON II" (manufactured by Beckman Coulter, Inc.), can be used as the electrolytic aqueous solution used in the measurement.

The settings for the aforementioned dedicated software are made in the following manner.

At the "Change the Standard Measurement Method (SOM)" screen of the dedicated software, the total count number of a control mode is set to 50,000 particles, the number of measurement cycles is set to 1, and a value obtained using the "Standard particle with a particle diameter of 10.0 μm" (manufactured by Beckman Coulter, Inc.) is set as a Kd value. A threshold and a noise level are automatically set by pushing a "Threshold/Noise Level Measurement Button". The current is set to 1,600 μA, the gain is set to 2, the electrolytic solution is set to ISOTON II, and a check box of "Flushing the Aperture Tube After the Measurement" is checked.

At the "Setting for Conversion from Pulse to Particle Diameter" screen of the dedicated software, the bin interval is set to a logarithmic particle diameter, the number of particle diameter bins is set to 256, and the particle diameter range is set from 2 μm to 60 μm.

A specific measurement method is described below.

(1) A total of 200 ml of the aforementioned aqueous electrolytic solution is introduced into a 250-ml round-bottom beaker made of glass that is specifically designed for Multisizer 3, the beaker is set on a sample stand, and stirring with a stirring rod is performed at a rate of 24 revolutions/sec in a counterclockwise direction. The dirt and gas bubbles in the aperture tube are removed by the "Aperture Flush" function of the dedicated software.

(2) A total of 30 ml of the aforementioned aqueous electrolytic solution is introduced into a 100-ml flat-bottom beaker made of glass. About 0.3 ml of a diluted solution prepared by diluting "Contaminon N" (a 10 wt % aqueous solution of a neutral detergent with a pH of 7 for washing precision measuring devices which is constituted by a nonionic surfactant, an anionic surfactant, and an organic builder; manufactured by Wako Pure Chemical Industries, Ltd.) with ion-exchange water by about three mass fold is added as a dispersant to the acquired electrolytic.

(3) An ultrasonic dispersing unit "Ultrasonic Dispersion System Tetoral 150" (manufactured by Nikkaki Bios Co.) with an electrical output of 120 W that incorporates two oscillators with an oscillation frequency of 50 kHz and a mutual phase difference of 180 degrees is prepared. About 3.3 l of ion-exchange water is poured into the water tank of the ultrasonic disperser, and about 2 ml of Contaminon N is added to the water tank.

(4) The beaker described in clause (2) hereinabove is set into a beaker fixing orifice of the ultrasonic dispersing unit, and the ultrasonic disperser is actuated. The height position of the beaker is then adjusted so as to obtain the maximum resonance state at the liquid surface in the aqueous electrolytic solution in the beaker.

(5) The toner (about 10 mg) is added by small portions to the aqueous electrolytic solution and dispersed therein, while the aqueous electrolytic solution in the beaker described in clause (4) hereinabove is irradiated with ultrasonic waves. The ultrasonic dispersion treatment is continued for additional 60 seconds. In the course of the ultrasonic treatment, water temperature in the water tank is appropriately adjusted to a value equal to or higher than 10° C. and equal to or lower than 40° C.

(6) The aqueous electrolytic solution having the toner dispersed therein as described clause (5) hereinabove, is dropwise added by using a pipette to the round-bottom beaker described in clause (1) hereinabove that has been placed in the sample stand, and the measurement concentration is adjusted to about 5%. The measurement is then performed with respect to 50,000 particles.

(7) The measurement data are analyzed with the aforementioned dedicated software provided with the device and the weight-average particle diameter (D4) and number-average particle diameter (D1) are calculated. The "Average Value" of the "Analysis/Volume Statistical Value (Arithmetic Average)" screen in the case of Graph/Volume % setting in the special software is the weight-average particle diameter (D4), and the "Average Value" of the "Analysis/Number Statistical Value (Arithmetic Average)" screen in the case of Graph/Number % setting in the special software is the number-average particle diameter (D1).

<Method for Measuring Melting Point of Crystalline Polyester, Block Polymer, and Wax>

The melting points of the crystalline polyester, block polymer and wax were measured under the following conditions by using DSC Q1000 (manufactured by TA Instruments).

Temperature rise rate: 10° C./min

Measurement start temperature: 20° C.

Measurement end temperature: 180° C.

Melting points of indium and zinc are used for temperature correction of the device detection unit, and the heat of fusion of indium is used for correcting the amount of heat.

More specifically, about 5 mg of the sample is weighted and placed in a silver pan for one cycle of measurements. An empty silver pan is used as a reference. The peak temperature of the highest endothermic peak in this case is taken as a melting point.

<Method for Measuring Number-Average Molecular Weight (Mn) and Weight-Average Molecular Weight (Mw)>

In accordance with the present invention, the number-average molecular weight (Mn) and weight-average molecular weight (Mw) of tetrahydrofuran (THF) solubles of the resin are measured in the following manner by gel permeation chromatography (GPC).

(1) Preparation of Measurement Sample

The resin (sample) and THF are mixed to a concentration of about 0.5 mg/ml to 5.0 mg/ml (for example, about 5 mg/ml), allowed to stay for several hours (for example, 5 hours to 6 hours) at room temperature, and then sufficiently shaken so that the THF and sample are thoroughly mixed till the sample associations are eliminated. The mixture is then allowed to stay in a stationary state for period equal to or longer than 12 hours (for example, 24 hours) at room temperature. In this case, the time interval from the mixing start point of the sample and THF till the stationary state end time is made equal to or longer than 24 hours.

A sample for GPC is then obtained by filtering through a sample processing filter (Maishori Disk H-25-5 with a pore size of 0.45 μm to 0.50 μm (manufactured by Tosoh Corporation) and Ekikuro Disk 25CR (manufactured by German Science Japan Co., Ltd.) can be advantageously used).

(2) Measurement of Sample

A column is stabilized in a heat chamber at 40° C., and the measurement is conducted by allowing THF as a solvent to flow at a flow rate of 1 ml per minute into the column at that temperature and injecting 50 μl to 200 μl of a THF sample solution of the resin adjusted to a sample concentration of 0.5 mg/ml to 5.0 mg/ml.

When the molecular weight of the sample is measured, the molecular weight distribution is calculated from a relationship between a count number and a logarithm value of a calibration curve plotted by using monodisperse polystyrene standard samples of several types.

Samples with a molecular weight of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$ manufactured by Pressure Chemical Co. or Toyo Soda Co. are used as the standard polystyrene samples for plotting the calibration curve. A RI (refractive index) detector is used for detection.

A combination of a plurality of commercial polystyrene gel columns is used as described hereinabove as columns in order to measure accurately a molecular weight region from $1\times10^3$ to $2\times10^6$. The GPC measurement conditions are described below.

[GPC Measurement Conditions]

Apparatus: LC-GPC 150C (manufactured by Waters Co.)

Column: A series of seven columns; Shodex KF-801, 802, 803, 804, 805, 806, and 807 (manufactured by Showa Denko K. K.)

Transfer phase: THF (tetrahydrofuran)

<Method for Measuring Particle Diameter of Wax Particles and Resin Fine Particles>

In accordance with the present invention, the particle diameter of wax particles and resin fine particles is measured using Microtrack particle size distribution measurement device HRA (X-100) (manufactured by Nikkiso K. K.) within a set range of 0.001 μm to 10 μm as a volume-average particle diameter (μm or nm). Water is selected as dilution solvent.

EXAMPLES

The present invention is described below in greater detail on the basis of examples thereof, but the present invention is not limited to those examples. In the examples and comparative examples, "parts" and "%" stand for "parts by weight" and "wt %", unless specifically stated otherwise.

<Synthesis of Crystalline Polyester 1>

The following starting materials were charged, while introducing nitrogen, into a two-neck flask that has been heated and dried.

| | |
|---|---|
| Sebacic acid | 123.9 parts by weight |
| 1.6-Hexanediol | 76.1 parts by weight |
| Dibutyltin oxide | 0.1 parts by weight |

After the atmosphere inside the system has been replaced with nitrogen by a decompression operation, stirring was conducted for 6 hours at 180° C. The temperature was then gradually raised to 230° C. under stirring and held thereafter for 2 hours. Once a viscous state has been assumed, cooling with air was performed to stop the reaction, thereby synthesizing crystalline polyester 1. Physical properties of the crystalline polyester 1 are shown in Table 1.

| | |
|---|---|
| Xylylene diisocyanate (XDI) | 122.9 parts by weight |
| Cyclohexane dimethanol (CHDM) | 7.1 parts by weight |
| Tetrahydrofuran (THF) | 150.0 parts by weight |

The system was heated to 50° C. and urethanization reaction was performed for 10 hours to obtain a block polymer intermediate product. The following starting materials were then charged into another reaction vessel equipped with a stirrer and a thermometer and dissolved at 50° C.

| | |
|---|---|
| Crystalline polyester 1 | 200.0 parts by weight |
| THF | 200.0 parts by weight |

A total of 100.0 parts by weight of the block polymer intermediate product was dropwise added at 50° C., while purging with nitrogen. Upon completion of the dropwise addition, the reaction was conducted at 50° C. for 10 hours, the THF, which was the solvent, was distilled out and block polymer 1 was obtained. Physical properties of block polymer 1 are shown in Table 2.

TABLE 1

| | Dicarboxylic acid | | Diol | | Physical properties of polyester | | |
|---|---|---|---|---|---|---|---|
| | Type | Amount added (parts by weight) | Type | Amount added (parts by weight) | Mn | Mw | Melting point (° C.) |
| Crystalline polyester 1 | Sebacic acid | 123.9 | Hexanediol | 76.1 | 5,500 | 12,300 | 67 |
| Crystalline polyester 2 | Sebacic acid | 119.1 | Hexanediol | 80.9 | 1,800 | 3,500 | 66 |
| Crystalline polyester 3 | Sebacic acid | 124.3 | Hexanediol | 75.7 | 7,300 | 15,000 | 68 |
| Crystalline polyester 4 | Sebacic acid | 151.0 | Ethanediol | 49.0 | 5,100 | 10,500 | 65 |

<Synthesis of Crystalline Polyesters 2 to 4>

Crystalline polyesters 2 to 4 were synthesized in exactly the same manner, except that the charges of starting materials in the synthesis of crystalline polyester 1 were changed as shown in Table 1. Physical properties of crystalline polyesters 2 to 4 are shown in Table 1.

<Synthesis of Block Polymer 1>

The following starting materials were charged, while performing purging with nitrogen, into a reaction vessel equipped with a stirrer and a thermometer.

TABLE 2

| | Portion that can have crystal structure | | Block polymer intermediate product | | | | Physical properties of block polymer | | | |
|---|---|---|---|---|---|---|---|---|---|---|
| | Type | Amount added (parts by weight) | Type | Amount added (parts by weight) | Type | Amount added (parts by weight) | Mn | Mw | Melting point (° C.) | SP(A) $((cal/cm^3)^{1/2})$ |
| Block polymer 1 | Crystalline polyester 1 | 200.0 | XDI | 122.9 | CHDM | 77.1 | 16,800 | 35,500 | 61 | 10.52 |
| Block polymer 2 | Crystalline polyester 3 | 200.0 | XDI | 130.6 | CHDM | 69.4 | 15,900 | 34,500 | 62 | 10.15 |
| Block polymer 3 | Crystalline polyester 4 | 200.0 | XDI | 120.6 | CHDM | 79.4 | 16,400 | 36,000 | 59 | 11.02 |

<Synthesis of Block Polymers 2 and 3>

Block polymers 2 and 3 were synthesized in exactly the same manner, except that the charges of starting materials in the synthesis of block polymer 1 were changed as shown in Table 2. Physical properties of block polymers 2 and 3 are shown in Table 2.

<Synthesis of Amorphous Binder Resin 1>

| | |
|---|---|
| Styrene | 75.0 parts by weight |
| n-Butyl acrylate | 25.0 parts by weight |
| β-Carboxyethyl acrylate | 3.0 parts by weight |
| Azobismethoxydimethylvaleronitrile | 0.3 parts by weight |
| n-Hexane | 80.0 parts by weight |

The above-described starting materials were charged into a beaker, a monomer solution was prepared by stirring and mixing at 20° C., and the prepared monomer solution was introduced into a dropping funnel that has been heated and dried in advance. Separately, 900.0 parts by weight of n-hexane was charged into a heated and dried two-neck flask. After purging with nitrogen, the dropping funnel was attached and the monomer solution was dropwise added over 1 hour at 40° C. The stirring was continued for 3 hours after the dropping has been completed, a mixture of 0.3 parts by weight of azobismethoxydimethylvaleronitrile and 80.0 parts by weight of n-hexane was dropwise added again and stirring was conducted for 3 hours at 40° C. Hexane was then removed to obtain amorphous binder resin 1. The SP value of the obtained amorphous binder resin was 9.88 $(cal/cm^3)^{1/2}$.

<Preparation of Binder Resin Solutions 1 to 3>

A total of 100.0 parts by weight of acetone and 100.0 parts by weight of block polymer 1 were charged into a beaker equipped with a stirrer, and stirring was continued at 40° C. till the block polymer was completely dissolved, thereby preparing binder resin solution 1. Binder resin solutions 2 and 3 were prepared in the same manner as binder resin solution 1 by replacing the block polymer 1 with block polymers 2 and 3.

<Preparation of Binder Resin Dispersion A-1>

A total of 50 parts by weight of the amorphous binder resin 1 was dissolved in 200.0 parts by weight of ethyl acetate, and 3.0 parts by weight of an anionic surfactant (sodium dodecylbenzenesulfonate) was added together with 200.0 parts by weight of ion-exchange water. The system was heated to 40° C. and stirred for 10 minutes at 8,000 rpm by using an emulsifier (ULTRA TURRAX T-50, manufactured by IKA), and ethyl acetate was then evaporated to prepare a binder resin dispersion A-1.

<Synthesis of Crystalline Polyester Modification Monomer 1>

Xylylene Diisocyanate (XDI) 59.0 Parts by Weight

This starting material was charged into a reaction vessel equipped with a stirring rod and a thermometer. Then, 41 parts by weight of 2-hydroxyethyl methacrylate was dropwise added, and the reaction was conducted for 4 hours at 55° C. to obtain a vinyl monomer intermediate product.

| | |
|---|---|
| Crystalline polyester 2 | 83.0 parts by weight |
| Tetrahydrofuran | 100.0 parts by weight |

Those starting materials were dissolved, while purging with nitrogen, at 50° C. in a reaction vessel equipped with a stirrer and a thermometer. A total of 10 parts by weight of the vinyl monomer intermediate product was dropwise added and the reaction was performed for 4 hours at 50° C. to obtain a solution of crystalline polyester monomer 1. The crystalline polyester modification monomer 1 was then obtained by decompression removing tetrahydrofuran with a rotary evaporator for 5 hours at 40° C.

<Preparation of Silicone Monomers 1 to 3>

In accordance with the present invention, silicone monomers 1 to 3 were used that had the composition shown in Table 3 and a methacrylated polysiloxane structure represented by general formula (II) below.

TABLE 3

[Chem. 2]

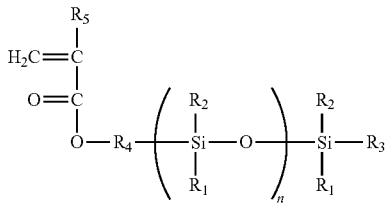

General Formula (II)

| | $R_1$ | $R_2$ | $R_3$ | $R_4$ | $R_5$ | n |
|---|---|---|---|---|---|---|
| Silicone monomer 1 | $CH_3$ | $CH_3$ | $CH_3$ | $C_3H_6$ | $CH_3$ | 3 |
| Silicone monomer 2 | $CH_3$ | $CH_3$ | $CH_3$ | $C_3H_6$ | $CH_3$ | 132 |
| Silicone monomer 3 | $CH_3$ | $CH_3$ | $CH_3$ | $C_3H_6$ | $CH_3$ | 11 |

<Synthesis of Resin B-1 and Preparation of Dispersion>

| | |
|---|---|
| Silicone monomer 1 | 10.0 parts by weight |
| Crystalline polyester modification monomer | 20.0 parts by weight |
| Styrene (St) | 60.0 parts by weight |
| Methacrylic acid (MAA) | 10.0 parts by weight |
| Azobismethoxydimethylvaleronitrile | 0.3 parts by weight |
| n-Hexane | 80.0 parts by weight |

The above-described starting materials were charged into a beaker, a monomer solution was prepared by stirring and mixing at 20° C., and the prepared monomer solution was introduced into a dropping funnel that has been heated and dried in advance. Separately, 900 parts by weight of n-hexane was charged into a heated and dried two-neck flask. After purging with nitrogen, the dropping funnel was attached and the monomer solution was dropwise added over 1 hour at 40° C. The stirring was continued for 3 hours after the dropping has been completed, a mixture of 0.3 parts by weight of azobismethoxydimethylvaleronitrile and 20.0 parts by weight of n-hexane was dropwise added again and stirring was conducted for 3 hours at 40° C. A resin dispersion B-1 constituted by resin B-1 was then obtained by cooling to room temperature. Physical properties of the resin B-1 are shown in Table 4.

TABLE 4

| | Monomer 1 (unit C) | | | Monomer 2 | | | Monomer 3 | | |
|---|---|---|---|---|---|---|---|---|---|
| | Type | Amount added (parts by weight) | SP(C) ((cal/cm$^3$)$^{1/2}$) | Type | Amount added (parts by weight) | SP(C) ((cal/cm$^3$)$^{1/2}$) | Type | Amount added (parts by weight) | SP(C) ((cal/cm$^3$)$^{1/2}$) |
| Resin B-1 | Silicone monomer 1 | 10.0 | 7.95 | | 20.0 | 10.10 | St | 60.0 | 9.83 |
| Resin B-2 | Silicone monomer 1 | 10.0 | 7.95 | | 20.0 | 10.10 | St | 60.0 | 9.83 |
| Resin B-3 | Silicone monomer 2 | 10.0 | 7.31 | Crystalline polyester modification monomer 1 | 20.0 | 10.10 | St | 55.0 | 9.83 |
| Resin B-4 | Silicone monomer 2 | 10.0 | 7.31 | Crystalline polyester modification monomer 1 | 20.0 | 10.10 | St | 60.0 | 9.83 |
| Resin B-5 | Silicone monomer 1 | 15.0 | 7.95 | Crystalline polyester modification monomer 1 | 20.0 | 10.10 | St | 32.0 | 9.83 |
| Resin B-6 | Silicone monomer 2 | 10.0 | 7.31 | Crystalline polyester modification monomer 1 | 20.0 | 10.10 | St | 37.0 | 9.83 |
| Resin B-7 | Silicone monomer 2 | 15.0 | 7.31 | Crystalline polyester modification monomer 1 | 20.0 | 10.10 | St | 32.0 | 9.83 |
| Resin B-8 | Behenyl acrylate | 10.0 | 8.92 | Crystalline polyester modification monomer 1 | 20.0 | 10.10 | St | 60.0 | 9.83 |
| Resin B-9 | Silicone monomer 2 | 20.0 | 7.31 | Crystalline polyester modification monomer 1 | 20.0 | 10.10 | EHA | 57.0 | 8.77 |
| Resin B-10 | Silicone monomer 1 | 25.0 | 7.95 | Crystalline polyester modification monomer 1 | 40.0 | 10.10 | EHA | 30.0 | 8.77 |
| Resin B-11 | Silicone monomer 3 | 3.0 | 7.57 | Crystalline polyester modification monomer 1 | 20.0 | 10.10 | St | 67.0 | 9.83 |
| Resin B-12 | Silicone monomer 3 | 10.0 | 7.57 | Crystalline polyester modification monomer 1 | 20.0 | 10.10 | St | 60.0 | 9.83 |
| Resin B-13 | Silicone monomer 1 | 10.0 | 7.95 | Behenyl acrylate | 20.0 | 8.92 | St | 60.0 | 9.83 |
| Resin B-14 | Silicone monomer 1 | 10.0 | 7.95 | Crystalline polyester modification monomer 1 | 20.0 | 10.10 | St | 50.0 | 9.83 |
| Resin B-15 | Silicone monomer 1 | 40.0 | 7.95 | Behenyl acrylate | 60.0 | 8.92 | — | — | |
| Resin B-16 | EHA | 10.0 | 8.77 | St | 80.0 | 9.83 | MAA | 10.0 | 12.54 |
| Resin B-17 | Silicone monomer 2 | 12.0 | 7.31 | St | 70.0 | 9.83 | BA | 15.0 | 9.77 |

| | Monomer 4 | | | Monomer 5 | | | Physical properties | |
|---|---|---|---|---|---|---|---|---|
| | Type | Amount added (parts by weight) | SP(C) ((cal/cm$^3$)$^{1/2}$) | Type | Amount added (parts by weight) | SP(C) ((cal/cm$^3$)$^{1/2}$) | Mw | SP(B) ((cal/cm$^3$)$^{1/2}$) |
| Resin B-1 | MAA | 10.0 | 12.54 | — | — | — | 81,400 | 9.93 |
| Resin B-2 | AA | 10.0 | 14.04 | — | — | — | 73,900 | 10.03 |
| Resin B-3 | AA | 15.0 | 14.04 | — | — | — | 94,100 | 10.10 |
| Resin B-4 | MAA | 10.0 | 12.54 | — | — | — | 78,500 | 9.83 |
| Resin B-5 | MAA | 3.0 | 12.54 | EHA | 30.0 | 8.77 | 83,000 | 9.36 |
| Resin B-6 | MAA | 3.0 | 12.54 | EHA | 30.0 | 8.77 | 99,900 | 9.36 |
| Resin B-7 | MAA | 3.0 | 12.54 | EHA | 30.0 | 8.77 | 88,600 | 9.23 |
| Resin B-8 | MAA | 10.0 | 12.54 | — | — | — | 79,200 | 10.01 |
| Resin B-9 | MAA | 3.0 | 12.54 | — | — | — | 84,800 | 8.81 |
| Resin B-10 | AA | 5.0 | 14.04 | — | — | — | 86,800 | 9.32 |
| Resin B-11 | MAA | 10.0 | 12.54 | — | — | — | 75,300 | 10.04 |
| Resin B-12 | MAA | 10.0 | 12.54 | — | — | — | 76,600 | 9.89 |
| Resin B-13 | AA | 10.0 | 14.04 | — | — | — | 92,800 | 9.79 |
| Resin B-14 | AA | 20.0 | 14.04 | — | — | — | 77,000 | 10.37 |
| Resin B-15 | — | — | — | — | — | — | 66,000 | 8.72 |
| Resin B-16 | — | — | — | — | — | — | 81,100 | 10.16 |
| Resin B-17 | β-CEA | 3.0 | 12.75 | — | — | — | 96,300 | 9.62 |

In the table, St stands for styrene, MAA—methacrylic acid, AA—acrylic acid, EHA—2-ethylhexyl acrylate, BA—butyl acrylate, and β-CEA—β-carboxyethyl acrylate. The SP value of each monomer represents the SP value of the repeating unit after the double bonds have been cleaved.

<Synthesis of Resins B-2 to B-16 and Preparation of Dispersions>

Resin dispersions B-2 to B-16 constituted by resins B-2 to B-16 were obtained by changing the types and amounts added of the monomers 1 to 5 in the synthesis of resin B-1 to those shown in Table 4. Physical properties of resins B-2 to B-16 are shown in Table 4.

<Synthesis of Resin B-17 and Preparation of Dispersion>

| | |
|---|---|
| Silicone monomer 2 | 12.0 parts by weight |
| Styrene (St) | 70.0 parts by weight |
| n-Butyl acrylate (BA) | 15.0 parts by weight |
| β-carboxyethyl acrylate (β-CEA) | 3.0 parts by weight |
| Azobismethoxydimethylvaleronitrile | 0.3 parts by weight |
| n-Hexane | 80.0 parts by weight |

The above-described starting materials were charged into a beaker, a monomer solution was prepared by stirring and mixing at 20° C., and the prepared monomer solution was introduced into a dropping funnel that has been heated and dried in advance. Separately, 900 parts by weight of n-hexane was charged into a heated and dried two-neck flask. After purging with nitrogen, the dropping funnel was attached and the monomer solution was dropwise added over 1 hour at 40° C. The stirring was continued for 3 hours after the dropping has been completed, a mixture of 0.3 parts by weight of azobismethoxydimethylvaleronitrile and 20.0 parts by weight of n-hexane was dropwise added again and stirring was conducted for 3 hours at 40° C. Resin B-17 was then obtained by cooling to room temperature, filtration, washing, and drying. The dispersion of resin dispersion B-17 constituted by resin B-17 resin was obtained in the same manner as described above, except that the resin in the preparation of binder resin dispersion A-1 was changed to resin B-17. Physical properties of resin B-17 are shown in Table 4.

<Preparation of Varnish Dispersion 1>

| | |
|---|---|
| Dipentaerythritol paltimic acid ester wax | 17.0 parts by weight |
| Nitrile-group-containing styrene acrylic resin (a copolymer obtained by copolymerization of 60.0 parts by weight of styrene, 30.0 parts by weight of n-butyl acrylate, and 10.0 parts by weight of acrylonitrile; peak molecular weight 8,500) | 8.0 parts by weight |
| Acetone | 75.0 parts by weight |

The above-described starting materials were charged into a glass beaker (manufactured by IWAKI Glass) equipped with a stirring impeller and the system was heated to 50° C. to dissolve the wax in acetone.

Then, the system was gradually cooled under slow stirring at 50 rpm for 3 hours to 25° C., to obtain a milk-white liquid.

The solution was charged together with 20.0 parts by weight of 1-mm glass beads into a heat-resistant vessel, and wax dispersion 1 was obtained by dispersing for 3 hours with a paint shaker (manufactured by Toyo Seiki K. K.).

The particle diameter of wax particles in the wax dispersion 1 was measured using Microtrack particle size distribution measurement device HRA (X-100) (manufactured by Nikkiso K. K.). The volume-average particle diameter was 150 nm. Physical properties are shown in Table 5.

TABLE 5

| Wax dispersion | Type | Melting point (° C.) | Volume-average particle diameter (nm) | SP(W) $((cal/cm^3)^{1/2})$ |
|---|---|---|---|---|
| 1 | Dipentaerythritol palmitic acid ester | 72 | 150 | 9.01 |
| 2 | Dipentaerythritol behenic acid ester | 82 | 160 | 8.90 |
| 3 | Glycerin tribehenate | 70 | 150 | 8.85 |
| 4 | Pentaerythritol palmitic acid ester | 69 | 180 | 8.97 |
| 5 | Paraffin wax HNP10 | 75 | 100 | 8.11 |
| 6 | Dipentaerythritol palmitic acid ester | 72 | 300 | 9.01 |
| 7 | Paraffin wax HNP10 | 75 | 200 | 8.11 |

<Preparation of Wax Dispersions 2 to 5>

Wax dispersions 2 to 5 were prepared in the same manner as the wax dispersion 1, except that the waxes shown in Table 5 were used instead of the dipentaerythritol paltimic acid ester wax used in wax dispersion 1.

<Preparation of Wax Dispersion 6>

| | |
|---|---|
| Dipentaerythritol paltimic acid ester wax | 30.0 parts by weight |
| Cationic surfactant Neogel RK (Daiichi Kogyo Seiyaku K. K.) | 5.0 parts by weight |
| Ion exchange water | 90.0 parts by weight |

The above-described components were mixed, heated to 95° C., and thoroughly dispersed with ULTRA TURRAX T-50 manufactured by IKA. The dispersion treatment was then performed with a Gualin homogenizer of a pressure discharge type and wax dispersion 6 with a volume-average particle diameter of 200 nm was obtained.

<Preparation of Wax Dispersion 7>

A wax dispersion 7 was prepared in the same manner as the wax dispersion 6, except that the wax shown in Table 5 was used instead of the dipentaerythritol paltimic acid ester wax used in wax dispersion 6. Physical properties of the wax are shown in Table 5.

<Preparation of Colorant Dispersion 1>

| | |
|---|---|
| C.I. Pigment Blue 15:3 | 100.0 parts by weight |
| Acetone | 150.0 parts by weight |
| Glass beads (1 mm) | 200.0 parts by weight |

The abovementioned materials were charged into a heat-resistant glass vessel and dispersed for 5 hours with a paint shaker. The glass beads were then removed with a Nylon mesh to obtain colorant dispersion 1.

<Preparation of Colorant Dispersion 2>

| | |
|---|---|
| C.I. Pigment Blue 15:3 | 45.0 parts by weight |
| Cationic surfactant Neogel RK (Daiichi Kogyo Seiyaku K. K.) | 5.0 parts by weight |
| Ion exchange water | 200.0 parts by weight |

The abovementioned materials were charged into a heat-resistant glass vessel and dispersed for 5 hours with a paint shaker. The glass beads were then removed with a Nylon mesh to obtain colorant dispersion 2.

<Manufacture of Carrier>

A silane coupling agent (3-(2-aminoethylaminopropyl)trimethoxysilane) was added at 4.0 wt % to a magnetite powder with a number-average particle diameter of 0.25 μm and a hematite powder with a number-average particle diameter of 0.60 μm, high-speed mixing and stirring were conducted in a vessel at a temperature equal to or higher than 100° C., and the fine powders were subjected to hydrophilic treatment.

| | |
|---|---|
| Phenol | 10.0 parts by weight |
| Formaldehyde solution (formaldehyde 40%, methanol 10%, water 50%) | 6.0 parts by weight |
| Magnetite subjected to hydrophilic treatment | 63.0 parts by weight |
| Hematite subjected to hydrophilic treatment | 21.0 parts by weight |

The abovementioned materials, 5 parts by weight of 28% ammonia water, and 10.0 parts by weight of water were placed in a flask, the temperature was raised to 85° C. and held for 30 minutes under stirring and mixing, and the mixture was polymerized for 3 hours and cured. Cooling was then performed to 30° C., water was added again, the supernatant liquid was removed, and the precipitate was washed with water and dried in air. The precipitate was then dried at 60° C. under a reduced pressure (equal to or lower than 5 mm Hg), and a spherical magnetic resin powder with a magnetic material dispersed therein was obtained.

A copolymer of methyl methacrylate and methyl methacrylate having a perfluoroalkyl group (copolymerization ratio (mass standard) 8:1, weight-average molecular weight 45,000) was used as the coat resin. A total of 10 parts by weight of melamine particles with a particle diameter of 290 nm and 6.0 parts by weight of carbon particles with a specific resistance of $1\times10^{-2}$ Ω·cm and a particle diameter of 30 nm were added to 100 parts by weight of the coat resin, and the components were dispersed for 30 minutes with an ultrasonic disperser. A coat solution in a mixed solvent of methyl ethyl ketone and toluene was then produced (solution concentration 10 wt %) so as to obtain 2.5 parts by weight of the coat resin component with respect to the abovementioned magnetic resin particles.

The solvent of the coat solution was vaporized at 70° C., while continuously applying a shear stress, and the resin coat was coated on the surface of magnetic resin particles. The magnetic carrier particles coated with the resin were heat treated under stirring for 2 hours at 100° C., cooled, ground, and then classified with a 200-mesh sieve to obtain a carrier with a number-average particle diameter of 33 μm, a true specific gravity of 3.53 g/cm$^3$, an apparent specific gravity of 1.84 g/cm$^3$, and an intensity of magnetization of 42 Am$^2$/kg.

Example 1

(Process for Manufacturing Toner Particles 1)

In the test apparatus shown in FIG. 1, initially, the valves V1, V2, and the pressure regulating valve V3 were closed, 77.0 parts by weight of resin dispersion B-1 was charged into a pressure-resistant granulation tank T1 equipped with a stirring mechanism and a filter for trapping toner particles, and the internal temperature was adjusted to 30° C. Then, the valve V1 was opened, carbon dioxide (purity 99.99%) was introduced from a cylinder B1 into the granulation tank T1 by using a pump P1, and once the internal pressure has reached 4 MPa, the valve V1 was closed.

Meanwhile, the binder resin solution 1, wax dispersion 1, colorant dispersion 1, and acetone were charged into a resin solution tank T2, and the internal temperature was adjusted to 30° C.

Then, the valve V2 was opened, the contents of the resin solution tank T2 were introduced into the granulation tank T1 by using a pump P2, while stirring inside the granulation tank T1 at 1,000 rpm, and after the entire contents have been introduced the valve V2 was closed.

The internal pressure of the granulation tank T1 after the introduction was 7 MPa.

The charge amounts of the material (weight ratio) were as follows.

| | |
|---|---|
| Binder resin solution 1 | 173.0 parts by weight |
| Wax dispersion 1 | 30.0 parts by weight |
| Colorant dispersion 1 | 15.0 parts by weight |
| Acetone | 35.0 parts by weight |
| Carbon dioxide | 200.0 parts by weight |

The mass of the introduced carbon dioxide was calculated by calculating the density of carbon dioxide from the temperature (15° C.) and pressure (7 MPa) of carbon dioxide by the state equation described in Journal of Physical and Chemical Reference data, vol. 25, P. 1509 to 1596, and multiplying the calculated density by the volume of the granulation tank T1.

After the introduction of the contents of the resin solution tank T2 into the granulation tank T1 has been completed, granulation was performed by further stirring for 3 minutes at 1,000 rpm.

The valve V1 was then opened and carbon dioxide was introduced from the cylinder B1 into the granulation tank T1 by using the pump P1. In this case, the pressure regulating valve V3 was set to 10 MPa and carbon dioxide was further circulated, while maintaining the internal pressure of the granulation tank T1 at 10 MPa. By such an operation, carbon dioxide including the organic solvent (mainly acetone) extracted from ten liquid droplets after the granulation was discharged into the solvent recovery tank T3 and the organic solvent and carbon dioxide were separated.

The introduction of carbon dioxide into the granulation tank T1 was stopped when the amount of carbon dioxide became 15-fold that of carbon dioxide initially introduced into the granulation tank T1. At this point of time, the operation of replacing the carbon dioxide including the organic solvent with carbon dioxide containing no organic solvent was completed.

The pressure regulating valve V3 was then further gradually opened and the internal pressure of the granulation tank T1 was reduced to the atmospheric pressure, thereby recovering the toner particles 1 trapped by the filter. The toner particles 1 had a core-shell structure.

(Process for Preparing Toner 1)

A total of 1.8 parts by weight of hydrophobic silica fine powder (number-average primary particle diameter is 7 nm) that was treated with hexamethyldisilazane and 0.15 parts by weight of rutile-type titanium oxide fine powder (number-average primary particle diameter is 30 nm) were mixed for 5 minutes with 100.0 parts by weight of the toner particles 1 in a Henschel mixer (manufactured by Mitsui Kosan K. K.) to obtain a toner 1 in accordance with the present invention. The properties of the toner are shown in Table 7. The evaluation results are shown in Table 8.

<Heat-Resistant Storage Ability after a Heat Cycling Test>

Figure 2:
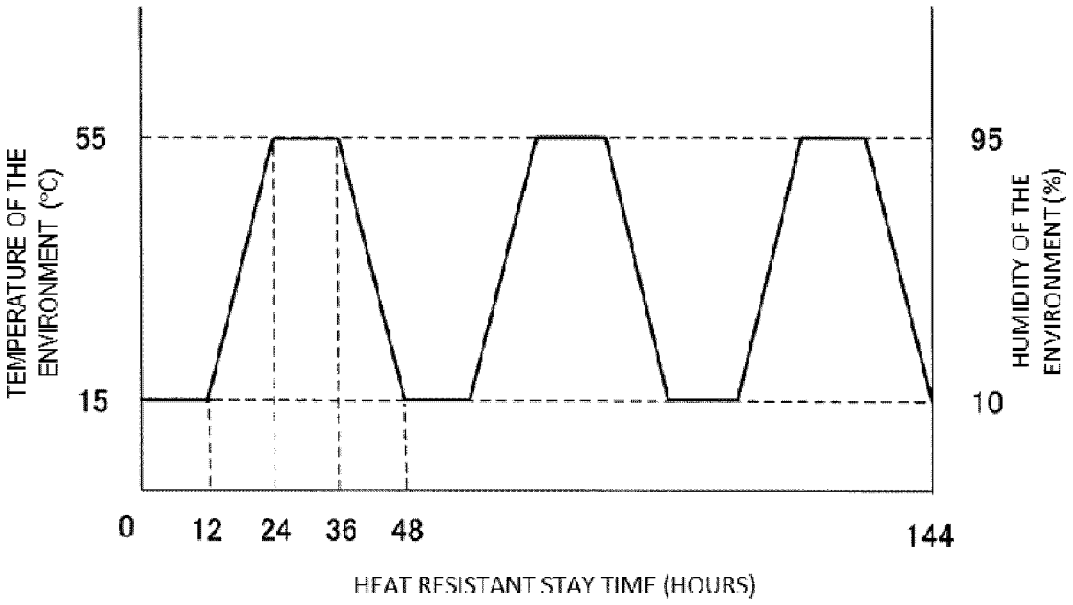
FIG. 2 is a drawing that illustrates the time chart of heat cycling.

About 10 g of the toner 1 was placed in a 100-ml polymer cup, allowed to stay for 12 hours under a low-temperature and low-humidity environment (15° C., 10% RH) and then allowed to stay for 12 hours under a high-temperature and high-humidity environment (55° C., 95% RH). After 12 hours of exposure to this environment, the toner was again allowed to stay for 12 hours under a low-temperature and low-humidity environment (15° C., 10% RH). The aforementioned operation was repeated three times, the toner was then taken out, and the aggregation thereof was checked. The time chart of heat cycling is shown in FIG. 2.

(Evaluation Criteria for Heat-Resistant Storage Ability)

A: Absolutely no aggregates are found and the state is substantially identical to the initial state.

B: Some aggregation seems to occur, but the aggregates collapse when the polymer cup is lightly shaken about 5 times and cause no particular problem.

C: Aggregates seem to occur, but can be easily loosened when touched with a finger; the toner is suitable for practical use.

D: Significant aggregation has occurred.

E: The toner formed a lump and cannot be used.

(Evaluation of Charge Retention Ability after a Heat Cycling Test)

The toner that has not been subjected to heat cycling was allowed to stay for 1 day under a NN environment (23° C., 60% RH) to prepare a reference product. The toner subjected to the heat cycling test was sieved with a 200-mesh (mesh size 75 μm) and allowed to stay for 1 day under the NN environment (23° C., 60% RH) to prepare an evaluation sample.

The toner and carrier (spherical carrier N-01 obtained by surface treating a ferrite core; standard carrier of The Imaging Society of Japan) were charged in respective amounts of 1.0 g and 19.0 g into a plastic bottle provided with a lid and allowed to stay for 1 day in a measurement environment. The plastic bottle with the toner and carrier loaded therein was set in a shaker (YS-LD, manufactured by Yayoi K. K.) and shaken for 1 minute at a speed of 4 cycles per second to charge electrically the developer constituted by the toner and carrier.

Figure 3:
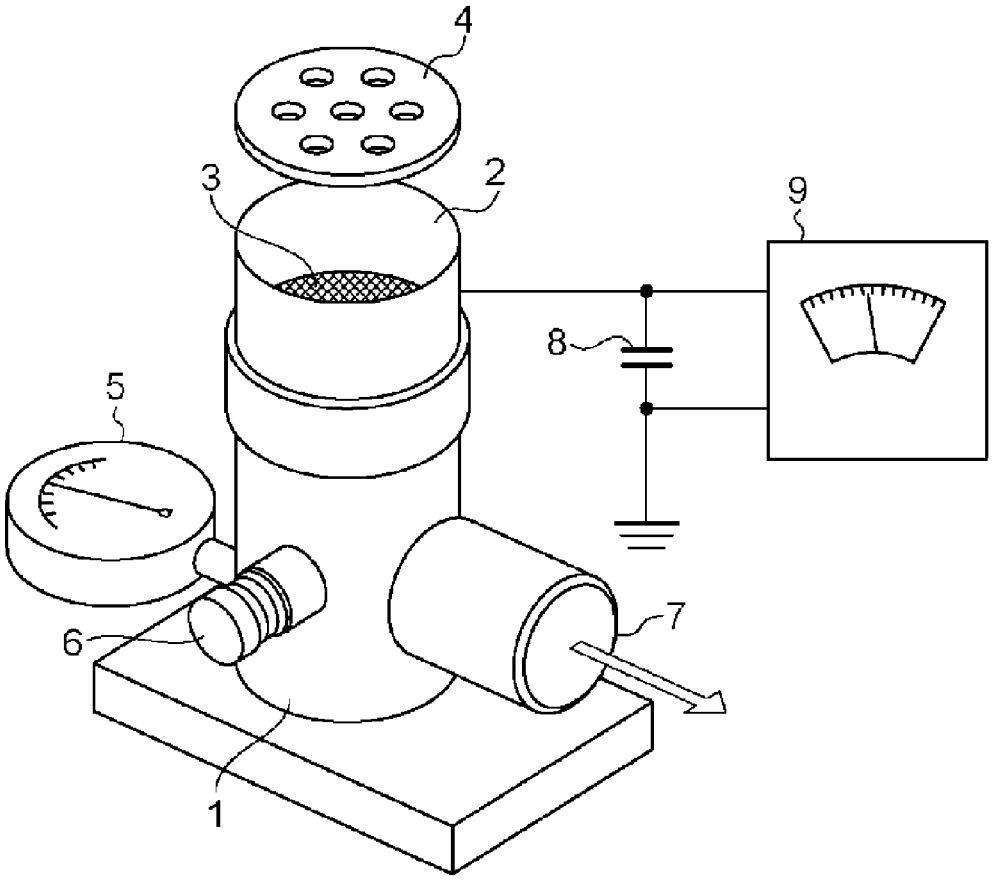
FIG. 3 is a drawing that illustrates an example of the apparatus for measuring the charge amount of the toner.

The triboelectric charge quantity was then measured with a device for measuring triboelectric charge quantity that is shown in FIG. 3. Referring to FIG. 3, about 0.5 g to 1.5 g of the aforementioned developer was introduced into the metal measurement container 2 having a 500-mesh (mesh is 25 μm) screen 3 at the bottom and the metal lid 4 was closed. The weight of the entire measurement container 2 at this point of point was weighed and denoted by W1 (*g*). Then, suction was carried out through the suction port 7 of the suction apparatus 1 (at least the part that is in contact with the measurement container 2 was an insulator), and the pressure on the vacuum gauge 5 was brought to 250 mmAq by adjusting the air blow control valve 6. Suction was carried out for 2 minutes in this state to suck in and remove the toner. The potential on the potentiometer 9 at this time is denoted by V (in volts). Here, the reference numeral 8 stands for a capacitor, and the capacitance thereof is denoted by C (mF). In addition, the post-suction weight of the entire measurement container was measured and denoted by W2 (*g*). The triboelectric charge quantity (mC/kg) of the sample was then calculated using the following formula:

$$\text{Triboelectric charge quantity (mC/kg) of the sample} = C \times V/(W1 - W2).$$

(Criteria for Evaluating Charge Retention Ability)

A: The difference between the charge quantity of the sample toner and the charge quantity of the standard product is less than 5%.

B: The difference between the charge quantity of the sample toner and the charge quantity of the standard product is equal to or greater than 5% and less than 10%.

C: The difference between the charge quantity of the sample toner and the charge quantity of the standard product is equal to or greater than 10% and less than 20%.

D: The difference between the charge quantity of the sample toner and the charge quantity of the standard product is equal to or greater than 20%.

E: The sample toner has aggregated and solidified and the charge cannot be evaluated.

This evaluation is designed to evaluate the exude state of the low-molecular components and wax from the core constituting the toner particle.

<Evaluation of Low-Temperature Fixability>

A two-component developer 1 was prepared by mixing 8.0 parts by weight of the toner 1 and 92.0 parts by weight of the carrier. The above-mentioned two-component developer 1 and a color laser copier CLC 5000 (Canon Inc.) were used for the evaluation. The development contrast of the copier was adjusted to obtain the toner placement amount on the paper of 1.2 mg/cm$^2$, and a "solid" non-fixed image with a distal end margin of 5 mm, a width of 100 mm, and a length of 280 mm was produced in a monochromatic mode under the conditions of normal temperature and normal humidity (23° C., 60% RH). The paper used was thick-sheet A4 paper ("Prover Bond Paper": 105 g/m$^2$, manufactured by Fox River Co.).

Then, the fixing unit of LBP5900 (Canon Inc.) was modified to allow for manual setting of fixation temperature, and the rotation speed of the fixing unit was changed to 270 mm/s and the nip pressure was changed to 120 kPa. The fixed images of the abovementioned "solid" non-fixed images at different temperatures were then obtained by using the modified fixing unit under the conditions of normal temperature and normal humidity (23° C., 60% RH) by increasing the fixation temperature by 5° C. within a range from 80° C. to 180° C.

A soft thin paper sheet (for example, "Dusper", registered trade name, manufactured by Ozu Sangyo K. K.) was then placed on the image region of the obtained fixed image, and the image region was rubbed back and forth 5 times, while applying a pressure of 4.9 kPa from above the thin paper sheet. The image density before and after the rubbing was measured and the image density decrease ratio ΔD (%) was calculated by the formula presented below. The temperature at which ΔD (%) was less than 10% was taken as the fixation start temperature and the low-temperature fixability was evaluated by the following evaluation criteria.

The image concentration was measured with a color reflection densitometer (Color reflection densitometer X-Rite 404A, manufactured by X-Rite Co.).

$$\text{(Formula)}: \Delta D(\%) = (\text{Image density before the rubbing} - \text{Image density after the rubbing})/\text{Image density before the rubbing} \times 100$$

(Evaluation Criteria)

A1: Fixation start temperature is equal to or less than 100° C.
A2: Fixation start temperature is 105° C.
B1: Fixation start temperature is 110° C.
B2: Fixation start temperature is 115° C.
C1: Fixation start temperature is 120° C.
C2: Fixation start temperature is 125° C.
D1: Fixation start temperature is 130° C.
D2: Fixation start temperature is 135° C.
E: Fixation start temperature is equal to or higher than 140° C.

In the present invention, the low-temperature fixability ranking up to C2 was determined to be good.

Examples 2 to 21

Toners 2 to 21 in accordance with the present invention were obtained in the same manner as in Example 1, except that the charged amounts of materials, with the exception of acetone and carbon dioxide, in the process of producing the toner particles 1 in Example 1 were changed as shown in Table 6. Properties of the obtained toners 2 to 21 are shown in Table 7, and the evaluation results obtained in the same manner as in Example 1 are shown in Table 8.

Example 22

| | |
|---|---|
| Binder resin dispersion A-1 | 432.5 parts by weight |
| Colorant dispersion 2 | 30.0 parts by weight |
| Wax dispersion 6 | 30.0 parts by weight |
| 10 wt % aqueous solution of aluminum polychloride | 1.5 parts by weight |

The above-described components were mixed in a round stainless steel flask, mixed and dispersed with ULTRA TURRAX T-50 manufactured by IKA, and then held for 60 minutes at 45° C. under stirring. Then, 77.0 parts by weight of the dispersion of resin B-11 was gradually added, the pH of the system was adjusted to 6 with 0.5 mol/L aqueous solution of sodium hydroxide, the stainless steel flask was then closed, and the system was heated to 96° C., while continuing stirring with a magnetic seal. In the heating process, an aqueous solution of sodium hydroxide was added, as appropriate, to prevent the pH from getting lower than 5.5. The system was then held for 5 hours at 96° C.

Upon completion of the reaction, the reaction product was cooled, filtered, and washed thoroughly with ion-exchange water. Solid-liquid separation was then performed by Nutsche vacuum filtration. The product was then redispersed in 3 L of ion-exchange water, stirred for 15 minutes at 300 rpm and washed. The above-described process was repeated 5 times and once the pH of the filtrate became 7.0, solid-liquid separation was performed by Nutsche vacuum filtration by using No. 5A filtration paper. Vacuum drying was then continued for 12 hours and toner particles 22 were obtained.

(Process for Preparing Toner 22)

A total of 1.8 parts by weight of hydrophobic silica fine particles (number-average primary particle diameter 7 nm) treated with hexamethyldisilazane and 0.15 parts by weight of rutile-type titanium oxide fine particles (number-average primary particle diameter 30 nm) were mixed for 5 minutes with 100.0 parts by weight of the toner particles 22 in a Henschel mixer (manufactured by Mitsui Kosan K. K.) to obtain a toner 22 in accordance with the present invention. The properties of the toner 22 are shown in Table 7. The evaluation results are shown in Table 8.

Comparative Examples 1 to 6

Comparative toners 23 to 28 were obtained in the same manner as in Example 1, except that the charged amounts of materials, with the exception of acetone and carbon dioxide, in the process of producing the toner particles 1 in Example 1 were changed as shown in Table 6. Properties of the obtained comparative toners 23 to 28 are shown in Table 7, and the evaluation results are shown in Table 8.

Comparative Examples 7 and 8

Comparative toners 29 and 30 were obtained in the same manner as in Example 22, except that the charged amounts of materials in the process of producing the toner particles 22 in Example 22 were changed as shown in Table 6. Properties of the obtained comparative toners 29 and 30 are shown in Table 7, and the evaluation results are shown in Table 8.

TABLE 6

| | | Binder resin A | | | Resin B | | |
|---|---|---|---|---|---|---|---|
| | | Starting materials used | Amount of liquid (parts by weight) | Amount of resin (parts by weight) | Starting materials used | Amount of liquid (parts by weight) | Amount of resin (parts by weight) |
| Examples | Toner particle 1 | Solution 1 | 173.0 | 86.5 | Dispersion B-1 | 77.0 | 7.0 |
| | Toner particle 2 | Solution 2 | 173.0 | 86.5 | Dispersion B-2 | 77.0 | 7.0 |
| | Toner particle 3 | Solution 1 | 173.0 | 86.5 | Dispersion B-1 | 77.0 | 7.0 |
| | Toner particle 4 | Solution 2 | 173.0 | 86.5 | Dispersion B-3 | 77.0 | 7.0 |
| | Toner particle 5 | Solution 2 | 173.0 | 86.5 | Dispersion B-1 | 77.0 | 7.0 |
| | Toner particle 6 | Solution 2 | 173.0 | 86.5 | Dispersion B-4 | 77.0 | 7.0 |
| | Toner particle 7 | Solution 3 | 173.0 | 86.5 | Dispersion B-5 | 77.0 | 7.0 |
| | Toner particle 8 | Solution 3 | 173.0 | 86.5 | Dispersion B-6 | 77.0 | 7.0 |
| | Toner particle 9 | Solution 3 | 173.0 | 86.5 | Dispersion B-7 | 77.0 | 7.0 |
| | Toner particle 10 | Solution 1 | 173.0 | 86.5 | Dispersion B-1 | 33.5 | 3.5 |
| | Toner particle 11 | Solution 1 | 173.0 | 86.5 | Dispersion B-1 | 110.0 | 10.0 |
| | Toner particle 12 | Solution 1 | 173.0 | 86.5 | Dispersion B-8 | 77.0 | 7.0 |
| | Toner particle 13 | Solution 1 | 173.0 | 86.5 | Dispersion B-9 | 77.0 | 7.0 |
| | Toner particle 14 | Solution 1 | 173.0 | 86.5 | Dispersion B-10 | 77.0 | 7.0 |
| | Toner particle 15 | Solution 1 | 173.0 | 86.5 | Dispersion B-11 | 77.0 | 7.0 |
| | Toner particle 16 | Solution 1 | 173.0 | 86.5 | Dispersion B-12 | 77.0 | 7.0 |
| | Toner particle 17 | Solution 1 | 173.0 | 86.5 | Dispersion B-12 | 77.0 | 7.0 |
| | Toner particle 18 | Solution 1 | 173.0 | 86.5 | Dispersion B-1 | 77.0 | 7.0 |
| | Toner particle 19 | Solution 1 | 173.0 | 86.5 | Dispersion B-1 | 77.0 | 7.0 |
| | Toner particle 20 | Solution 1 | 173.0 | 86.5 | Dispersion B-1 | 77.0 | 7.0 |
| | Toner particle 21 | Solution 1 | 173.0 | 86.5 | Dispersion B-1 | 77.0 | 7.0 |
| | Toner particle 22 | Dispersion A-1 | 432.5 | 108.1 | Dispersion B-13 | 77.0 | 7.0 |
| Comparative Examples | Toner particle 23 | Solution 2 | 173.0 | 86.5 | Dispersion B-14 | 77.0 | 7.0 |
| | Toner particle 24 | Solution 3 | 173.0 | 86.5 | Dispersion B-9 | 77.0 | 7.0 |
| | Toner particle 25 | Solution 1 | 173.0 | 86.5 | Dispersion B-8 | 77.0 | 7.0 |
| | Toner particle 26 | Solution 1 | 173.0 | 86.5 | Dispersion B-1 | 22.0 | 2.0 |
| | Toner particle 27 | Solution 1 | 173.0 | 86.5 | Dispersion B-1 | 187.0 | 17.0 |
| | Toner particle 28 | Solution 3 | 173.0 | 86.5 | Dispersion B-15 | 165.0 | 15.0 |
| | Toner particle 29 | Dispersion A-1 | 432.5 | 108.1 | Dispersion B-16 | 77.0 | 7.0 |
| | Toner particle 30 | Dispersion A-1 | 230.0 | 57.5 | Dispersion B-17 | 180.0 | 36.0 |
| | | Dispersion B-17 | 200.0 | 40.0 | | | |

| | | Wax dispersion | | | Pigment dispersion | | |
|---|---|---|---|---|---|---|---|
| | | Starting materials used | Amount of liquid (parts by weight) | Amount of wax (parts by weight) | Starting materials used | Amount of liquid (parts by weight) | Amount of pigment (parts by weight) |
| Examples | Toner particle 1 | Dispersion 1 | 30.0 | 5.0 | Dispersion 1 | 15.0 | 7.0 |
| | Toner particle 2 | Dispersion 5 | 30.0 | 5.0 | Dispersion 1 | 15.0 | 7.0 |
| | Toner particle 3 | Dispersion 5 | 30.0 | 5.0 | Dispersion 1 | 15.0 | 7.0 |
| | Toner particle 4 | Dispersion 1 | 30.0 | 5.0 | Dispersion 1 | 15.0 | 7.0 |
| | Toner particle 5 | Dispersion 2 | 30.0 | 5.0 | Dispersion 1 | 15.0 | 7.0 |
| | Toner particle 6 | Dispersion 1 | 30.0 | 5.0 | Dispersion 1 | 15.0 | 7.0 |

TABLE 6-continued

| | | | | | | | |
|---|---|---|---|---|---|---|---|
| | Toner particle 7 | Dispersion 2 | 30.0 | 5.0 | Dispersion 1 | 15.0 | 7.0 |
| | Toner particle 8 | Dispersion 1 | 30.0 | 5.0 | Dispersion 1 | 15.0 | 7.0 |
| | Toner particle 9 | Dispersion 1 | 30.0 | 5.0 | Dispersion 1 | 15.0 | 7.0 |
| | Toner particle 10 | Dispersion 1 | 30.0 | 5.0 | Dispersion 1 | 15.0 | 7.0 |
| | Toner particle 11 | Dispersion 1 | 30.0 | 5.0 | Dispersion 1 | 15.0 | 7.0 |
| | Toner particle 12 | Dispersion 1 | 30.0 | 5.0 | Dispersion 1 | 15.0 | 7.0 |
| | Toner particle 13 | Dispersion 1 | 30.0 | 5.0 | Dispersion 1 | 15.0 | 7.0 |
| | Toner particle 14 | Dispersion 1 | 30.0 | 5.0 | Dispersion 1 | 15.0 | 7.0 |
| | Toner particle 15 | Dispersion 1 | 30.0 | 5.0 | Dispersion 1 | 15.0 | 7.0 |
| | Toner particle 16 | Dispersion 3 | 30.0 | 5.0 | Dispersion 1 | 15.0 | 7.0 |
| | Toner particle 17 | Dispersion 4 | 30.0 | 5.0 | Dispersion 1 | 15.0 | 7.0 |
| | Toner particle 18 | Dispersion 1 | 6.0 | 1.0 | Dispersion 1 | 15.0 | 7.0 |
| | Toner particle 19 | Dispersion 1 | 96.0 | 16.0 | Dispersion 1 | 15.0 | 7.0 |
| | Toner particle 20 | Dispersion 1 | 18.0 | 3.0 | Dispersion 1 | 15.0 | 7.0 |
| | Toner particle 21 | Dispersion 1 | 72.0 | 12.0 | Dispersion 1 | 15.0 | 7.0 |
| | Toner particle 22 | Dispersion 6 | 30.0 | 5.0 | Dispersion 2 | 30.0 | 6.0 |
| Comparative Examples | Toner particle 23 | Dispersion 1 | 30.0 | 5.0 | Dispersion 1 | 15.0 | 7.0 |
| | Toner particle 24 | Dispersion 1 | 30.0 | 5.0 | Dispersion 1 | 15.0 | 7.0 |
| | Toner particle 25 | Dispersion 3 | 30.0 | 5.0 | Dispersion 1 | 15.0 | 7.0 |
| | Toner particle 26 | Dispersion 1 | 30.0 | 5.0 | Dispersion 1 | 15.0 | 7.0 |
| | Toner particle 27 | Dispersion 1 | 30.0 | 5.0 | Dispersion 1 | 15.0 | 7.0 |
| | Toner particle 28 | Dispersion 5 | 30.0 | 5.0 | Dispersion 1 | 15.0 | 7.0 |
| | Toner particle 29 | Dispersion 7 | 30.0 | 5.0 | Dispersion 2 | 30.0 | 6.0 |
| | Toner particle 30 | Dispersion 7 | 30.0 | 5.0 | Dispersion 2 | 30.0 | 6.0 |

The toner particles 1 to 30 all had a core-shell structure.

TABLE 7

| | | Binder resin (A) | Resin (B) | | Wax | | SP value | | | | |
|---|---|---|---|---|---|---|---|---|---|---|---|
| | | SP(A) ((cal/cm$^3$)$^{1/2}$) | SP(B) ((cal/cm$^3$)$^{1/2}$) | SP(C) ((cal/cm$^3$)$^{1/2}$) | Wax amount (parts by weight) | SP(W) ((cal/cm$^3$)$^{1/2}$) | ⊿SP(A) − ⊿SP(B) ((cal/cm$^3$)$^{1/2}$) | ⊿SP(W) − ⊿SP(C) ((cal/cm$^3$)$^{1/2}$) | Dn | Dv | Dv/Dn |
| Examples | Toner 1 | 10.52 | 9.93 | 7.95 | 5.0 | 9.01 | 0.59 | 1.06 | 5.69 | 6.21 | 1.09 |
| | Toner 2 | 10.15 | 10.03 | 7.95 | 5.0 | 8.11 | 0.12 | 0.16 | 5.74 | 6.34 | 1.10 |
| | Toner 3 | 10.52 | 9.93 | 7.95 | 5.0 | 8.11 | 0.59 | 0.16 | 5.59 | 6.04 | 1.08 |
| | Toner 4 | 10.15 | 10.10 | 7.31 | 5.0 | 9.01 | 0.05 | 1.70 | 5.64 | 6.38 | 1.13 |
| | Toner 5 | 10.15 | 9.93 | 7.95 | 5.0 | 8.90 | 0.22 | 0.95 | 5.81 | 6.53 | 1.12 |
| | Toner 6 | 10.15 | 9.83 | 7.31 | 5.0 | 9.01 | 0.32 | 1.70 | 5.16 | 5.92 | 1.15 |
| | Toner 7 | 11.02 | 9.36 | 7.95 | 5.0 | 8.90 | 1.66 | 0.95 | 5.50 | 6.40 | 1.16 |
| | Toner 8 | 11.02 | 9.36 | 7.31 | 5.0 | 9.01 | 1.66 | 1.70 | 5.63 | 6.04 | 1.07 |
| | Toner 9 | 11.02 | 9.23 | 7.31 | 5.0 | 9.01 | 1.79 | 1.70 | 5.78 | 6.33 | 1.10 |
| | Toner 10 | 10.52 | 9.93 | 7.95 | 5.0 | 9.01 | 0.59 | 1.06 | 6.13 | 6.94 | 1.13 |
| | Toner 11 | 10.52 | 9.93 | 7.95 | 5.0 | 9.01 | 0.59 | 1.06 | 5.02 | 5.77 | 1.15 |
| | Toner 12 | 10.52 | 10.01 | 8.92 | 5.0 | 9.01 | 0.51 | 0.09 | 5.49 | 6.01 | 1.09 |
| | Toner 13 | 10.52 | 8.81 | 7.31 | 5.0 | 9.01 | 1.71 | 1.70 | 5.64 | 6.08 | 1.08 |
| | Toner 14 | 10.52 | 9.32 | 7.95 | 5.0 | 9.01 | 1.20 | 1.06 | 5.53 | 6.14 | 1.11 |
| | Toner 15 | 10.52 | 10.04 | 7.57 | 5.0 | 9.01 | 0.48 | 1.44 | 5.97 | 6.81 | 1.14 |
| | Toner 16 | 10.52 | 9.89 | 7.57 | 5.0 | 8.85 | 0.63 | 1.28 | 5.88 | 6.82 | 1.16 |
| | Toner 17 | 10.52 | 9.89 | 7.57 | 5.0 | 8.97 | 0.63 | 1.40 | 5.71 | 6.59 | 1.15 |
| | Toner 18 | 10.52 | 9.93 | 7.95 | 1.0 | 9.01 | 0.59 | 1.06 | 5.60 | 5.91 | 1.06 |
| | Toner 19 | 10.52 | 9.93 | 7.95 | 16.0 | 9.01 | 0.59 | 1.06 | 5.77 | 6.71 | 1.16 |
| | Toner 20 | 10.52 | 9.93 | 7.95 | 3.0 | 9.01 | 0.59 | 1.06 | 5.67 | 6.47 | 1.14 |
| | Toner 21 | 10.52 | 9.93 | 7.95 | 12.0 | 9.01 | 0.59 | 1.06 | 5.73 | 6.65 | 1.16 |
| | Toner 22 | 9.88 | 9.79 | 7.95 | 5.0 | 9.01 | 0.09 | 1.06 | 5.34 | 5.95 | 1.11 |
| Comparative Examples | Toner 23 | 10.15 | 10.37 | 7.95 | 5.0 | 9.01 | −0.22 | 1.06 | 6.48 | 8.40 | 1.30 |
| | Toner 24 | 11.02 | 8.81 | 7.31 | 5.0 | 9.01 | 2.21 | 1.70 | 6.34 | 8.94 | 1.41 |
| | Toner 25 | 10.52 | 10.01 | 8.92 | 5.0 | 8.85 | 0.51 | −0.07 | 5.73 | 6.59 | 1.15 |
| | Toner 26 | 10.52 | 9.93 | 7.95 | 5.0 | 9.01 | 0.59 | 1.06 | 5.85 | 7.84 | 1.34 |
| | Toner 27 | 10.52 | 9.93 | 7.95 | 5.0 | 9.01 | 0.59 | 1.06 | 4.87 | 6.58 | 1.35 |
| | Toner 28 | 11.02 | 8.72 | 7.31 | 5.0 | 8.11 | 2.30 | 0.80 | 5.07 | 7.32 | 1.44 |
| | Toner 29 | 9.88 | 9.94 | 9.83 | 5.0 | 8.11 | −0.06 | −1.72 | 5.66 | 7.47 | 1.32 |
| | Toner 30 | 9.74 | 9.62 | 7.31 | 5.0 | 8.11 | 0.12 | 0.80 | 5.84 | 6.98 | 1.20 |

TABLE 8

| | | Heat-resistant storage ability after heat cycling | Charge retention ability after heat cycling (%) | Low-temperature fixing performance (° C.) |
|---|---|---|---|---|
| Examples | Toner 1 | A | A (2) | A1 (100) |
| | Toner 2 | C | C (16) | A1 (100) |
| | Toner 3 | B | C (12) | A1 (100) |
| | Toner 4 | C | B (9) | B1 (110) |
| | Toner 5 | A | B (5) | A1 (100) |
| | Toner 6 | B | B (8) | B1 (110) |
| | Toner 7 | B | B (7) | A1 (100) |
| | Toner 8 | B | B (8) | B1 (110) |
| | Toner 9 | C | B (8) | B1 (110) |
| | Toner 10 | C | C (18) | A1 (100) |
| | Toner 11 | A | A (3) | C1 (120) |
| | Toner 12 | C | C (18) | A1 (100) |
| | Toner 13 | B | C (15) | C2 (125) |
| | Toner 14 | A | A (2) | C1 (120) |
| | Toner 15 | C | B (9) | A1 (100) |
| | Toner 16 | A | A (4) | A1 (100) |
| | Toner 17 | A | A (2) | A1 (100) |
| | Toner 18 | A | A (4) | C1 (120) |
| | Toner 19 | C | C (14) | A1 (100) |
| | Toner 20 | A | A (2) | B1 (110) |
| | Toner 21 | B | C (13) | A1 (100) |
| | Toner 22 | B | B (7) | C1 (120) |
| Comparative Examples | Toner 23 | C | D (47) | C1 (120) |
| | Toner 24 | D | D (23) | C2 (125) |
| | Toner 25 | D | D (77) | A1 (100) |
| | Toner 26 | D | D (64) | B1 (110) |
| | Toner 27 | A | A (1) | D1 (130) |
| | Toner 28 | D | E (—) | B1 (110) |
| | Toner 29 | E | D (83) | C1 (120) |
| | Toner 30 | A | A (3) | E (140) |

REFERENCE SIGNS LIST

1: suction device (at least the portion that comes into contact with the measurement vessel 2 is an insulator)
2: measurement vessel made from a metal
3: 500-mesh screen
4: metallic cover
5: vacuometer
6: air amount regulating valve
7: suction port
8: capacitor
9: potentiometer
T1: granulation tank
T2: resin solution tank
T3: solvent recovery tank
B1: carbon dioxide cylinder
P1, P2: pumps
V1, V2: valves
V3: pressure regulating valve While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-125765, filed on Jun. 3, 2011 which is hereby incorporated by reference herein in their entirety.

What is claimed is:

1. A toner comprising toner particles wherein each of the toner particles has a core-shell structure composed of a core and a shell phase formed on the core, the shell phase contains a resin (B), and the core contains a binder resin (A), a colorant and a wax, wherein the toner particles contain the resin (B) in an amount equal to or greater than 3.0 parts by weight and equal to or less than 15.0 parts by weight per 100.0 parts by weight of the core, and where a solubility parameter (SP value) of the binder resin (A) is denoted by SP(A) [$(cal/cm^3)^{1/2}$], an SP value of the resin (B) is denoted by SP(B) [$(cal/cm^3)^{1/2}$], an SP value of a repeating unit with the smallest SP value from among repeating units constituting the resin (B) is denoted by SP(C) [$(cal/cm^3)^{1/2}$], and an SP value of the wax is denoted by SP(W) [$(cal/cm^3)^{1/2}$], SP(A) is equal to or greater than 9.00 $(cal/cm^3)^{1/2}$ and equal to or less than 12.00 $(cal/cm^3)^{1/2}$, SP(W) is equal to or greater than 7.50 $(cal/cm^3)^{1/2}$ and equal to or less than 9.50 $(cal/cm^3)^{1/2}$, each of SP(A), SP(B), SP(C) and SP(W) satisfy relationships represented by Formulas (1) and (2) below:

$$0.00<\{SP(A)-SP(B)\}\leq 2.00 \quad (1)$$

$$0.00<\{SP(W)-SP(C)\}\leq 2.00 \quad (2), \text{ and}$$

the repeating unit with the smallest SP value from among the repeating units constituting the resin (B) is represented by General Formula (I) below:

General Formula (I)

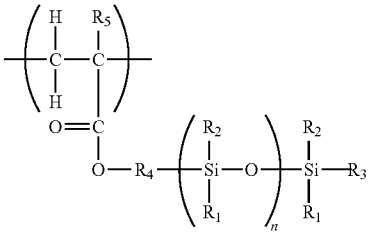

in General Formula (I), $R_1$, $R_2$ and $R_3$ represent alkyl groups having a linear or branched chain with 1 to 5 carbon atoms, n is an integer from 2 to 200, $R_4$ is an alkylene group having 1 to 10 carbon atoms, and $R_5$ is a hydrogen atom or a methyl group.

2. The toner according to claim 1, wherein each of the SP(B), the SP(C) and the SP(W) satisfy a relationship represented by Formula (3) below:

$$SP(C)<SP(W)<SP(B) \quad (3).$$

3. The toner according to claim 1, wherein the resin (B) is a vinyl resin prepared by copolymerizing a monomer providing the repeating unit with the smallest SP value from among the repeating units constituting the resin (B), and another vinyl monomer at a weight ratio of 5:95 to 20:80.

4. The toner according to claim 1, wherein each of the SP(A), SP(B) SP(C) and SP(W) satisfy relationships represented by Formulas (4) and (5) below:

$$0.20<\{SP(A)-SP(B)\}\leq 1.70 \quad (4)$$

$$0.90\leq\{SP(W)-SP(C)\}\leq 2.00 \quad (5).$$

5. The toner according to claim 1, wherein the SP(W) is equal to or greater than 8.50 $(cal/cm^3)^{1/2}$ and equal to or less than 9.50 $(cal/cm^3)^{1/2}$.

6. The toner according to claim 1, wherein the toner particles contain the wax in an amount equal to or greater than 2.0 parts by weight and equal to or less than 20.0 parts by weight in 100.0 parts by weight of the core.

7. The toner according to claim 1, wherein the toner particles are formed by dispersing a resin composition in which the binder resin (A), the colorant, and the wax are dissolved or dispersed in a medium containing an organic solvent, in a dispersion medium in which fine resin particles including the resin (B) are dispersed and which contains carbon dioxide in a supercritical state or a liquid state, and removing the organic solvent from the obtained dispersion.

8. A toner comprising toner particles wherein each of the toner particles has a core-shell structure composed of a core and a shell phase formed on the core, the shell phase contains a resin (B), and the core contains a binder resin (A), a colorant and a wax, wherein the toner particles contain the resin (B) in an amount equal to or greater than 3.0 parts by weight and equal to or less than 15.0 parts by weight per 100.0 parts by weight of the core, and where a solubility parameter (SP value) of the binder resin (A) is denoted by SP(A) [$(cal/cm^3)^{1/2}$], an SP value of the resin (B) is denoted by SP(B) [$(cal/cm^3)^{1/2}$], an SP value of a repeating unit with the smallest SP value from among repeating units constituting the resin (B) is denoted by SP(C) [$(cal/cm^3)^{1/2}$], and an SP value of the wax is denoted by SP(W) [$(cal/cm^3)^{1/2}$], SP(A) is equal to or greater than 9.00 $(cal/cm^3)^{1/2}$ and equal to or less than 12.00 $(cal/cm^3)^{1/2}$, SP(W) is equal to or greater than 7.50 $(cal/cm^3)^{1/2}$ and equal to or less than 9.50 $(cal/cm^3)^{1/2}$, each of SP(A), SP(B), SP(C) and SP(W) satisfy relationships represented by Formulas (1) and (2) below:

$$0.00<\{SP(A)-SP(B)\}\leq 2.00 \quad (1)$$

$$0.00<\{SP(W)-SP(C)\}\leq 2.00 \quad (2), \text{ and}$$

the resin (B) comprises a repeating unit represented by General Formula (I) below:

General Formula (I)

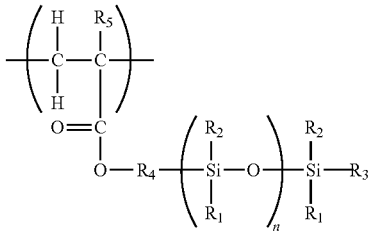

in General Formula (I), $R_1$, $R_2$ and $R_3$ represent alkyl groups having a linear or branched chain with 1 to 5 carbon atoms, n is an integer from 2 to 200, $R_4$ is an alkylene group having 1 to 10 carbon atoms, and $R_5$ is a hydrogen atom or a methyl group.

* * * * *